US011766071B2

(12) United States Patent
Cornils et al.

(10) Patent No.: US 11,766,071 B2
(45) Date of Patent: Sep. 26, 2023

(54) VAPORIZER UNIT FOR INHALER AND METHOD FOR PRODUCING VAPORIZER UNITS

(71) Applicant: KÖRBER TECHNOLOGIES GMBH, Hamburg (DE)

(72) Inventors: Lasse Cornils, Hamburg (DE); Christian Hanneken, Hamburg (DE); Svenja Käthner, Hamburg (DE); Michael Kleine Wächter, Lankau (DE); Niklas Romming, Hamburg (DE); Christof Schuster, Hamburg (DE); Arne Rosenbohm, Steinkirchen (DE); Gunnar Niebuhr, Hamburg (DE); Rene Schmidt, Buchholz i.d.N. (DE); Finn-Oliver Pankoke, Uetersen (DE); Dennis Leichsenring, Hamburg (DE); Jan Jaklin, Fellbach (DE); Max Bergmann, Hamburg (DE)

(73) Assignee: KÖRBER TECHNOLOGIES GMBH, Hamburg (DE)

( * ) Notice: Subject to any disclaimer, the term of this patent is extended or adjusted under 35 U.S.C. 154(b) by 386 days.

(21) Appl. No.: 17/125,663

(22) Filed: Dec. 17, 2020

(65) Prior Publication Data

US 2021/0186116 A1 Jun. 24, 2021

(30) Foreign Application Priority Data

Dec. 19, 2019 (DE) ..... 102019135177.4

(51) Int. Cl.
*A24F 40/46* (2020.01)
*A24F 40/70* (2020.01)
(Continued)

(52) U.S. Cl.
CPC ..... *A24F 40/46* (2020.01); *A24F 40/53* (2020.01); *A24F 40/65* (2020.01); *A24F 40/70* (2020.01)

(58) Field of Classification Search
None
See application file for complete search history.

(56) References Cited

U.S. PATENT DOCUMENTS 7,752,746 B2 * 7/2010 Chen ..... H05K 1/189 29/829
2004/0078965 A1 * 4/2004 Miyakawa ..... H05K 5/068 29/841

(Continued)

FOREIGN PATENT DOCUMENTS

DE 102017130501 A1 6/2019
DE 102018105220 A1 9/2019

(Continued)

*Primary Examiner* — James Harvey
(74) *Attorney, Agent, or Firm* — DINSMORE & SHOHL LLP

(57) ABSTRACT

A method for producing vaporizer units as a component of inhalers includes the steps: a) providing a flexible circuit board material with sites for individual vaporizer units, the material optionally prestructured with conductor paths and/or pre-punched areas predetermined in terms of position/course for each site; b) providing and placing a heating element which may be electrically connected to the conductor paths; and c) at least partial covering each site with a sealing material for the formation of a partial sheathing for each vaporizer unit. The sealing material is applied such that the sheathing covers an edge region of the heating element while keeping open a heating surface on an upper side of the circuit board material. At least the outer surfaces of the sheathing pointing away from the circuit board material (Continued)

form sealing surfaces. Vaporizer units, vaporizer assemblies, vaporizer cartridges and inhalers with such vaporizer units are also provided.

35 Claims, 16 Drawing Sheets

(51) Int. Cl.
*A24F 40/53* (2020.01)
*A24F 40/65* (2020.01)

(56) References Cited

U.S. PATENT DOCUMENTS

| | | | | |
|---|---|---|---|---|
| 2015/0116285 | A1 | 4/2015 | Kling | |
| 2016/0037624 | A1* | 2/2016 | Yu | H05K 3/4655 156/60 |
| 2018/0116285 | A1* | 5/2018 | Polloni | A24F 40/70 |
| 2018/0263290 | A1* | 9/2018 | Collett | A24F 40/51 |
| 2019/0183180 | A1 | 6/2019 | Rath et al. | |
| 2020/0374985 | A1 | 11/2020 | Dietmann et al. | |
| 2020/0397052 | A1 | 12/2020 | Pelz et al. | |
| 2021/0186116 | A1* | 6/2021 | Cornils | A24F 40/70 |
| 2022/0225686 | A1* | 7/2022 | Romming | A24F 40/70 |

FOREIGN PATENT DOCUMENTS

| | | | |
|---|---|---|---|
| EP | 3025601 | B1 | 10/2017 |
| WO | 2015035510 | A1 | 3/2016 |
| WO | 2016166661 | A1 | 10/2016 |
| WO | 2016166670 | A1 | 10/2016 |
| WO | 2018019486 | A1 | 2/2018 |
| WO | 2018219584 | A1 | 12/2018 |
| WO | 2019127643 | A1 | 7/2019 |

* cited by examiner

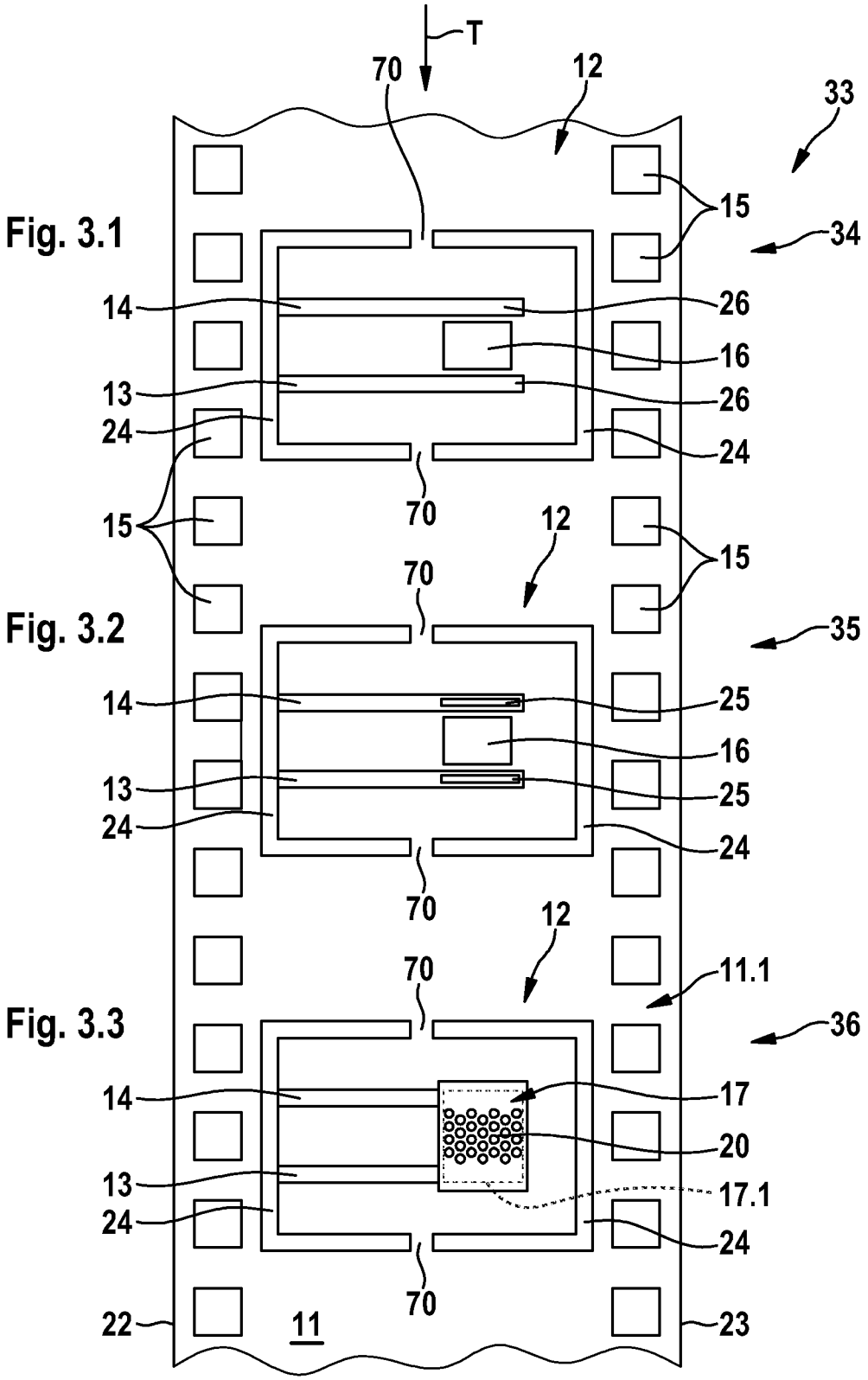
Fig. 3.1
Fig. 3.2
Fig. 3.3

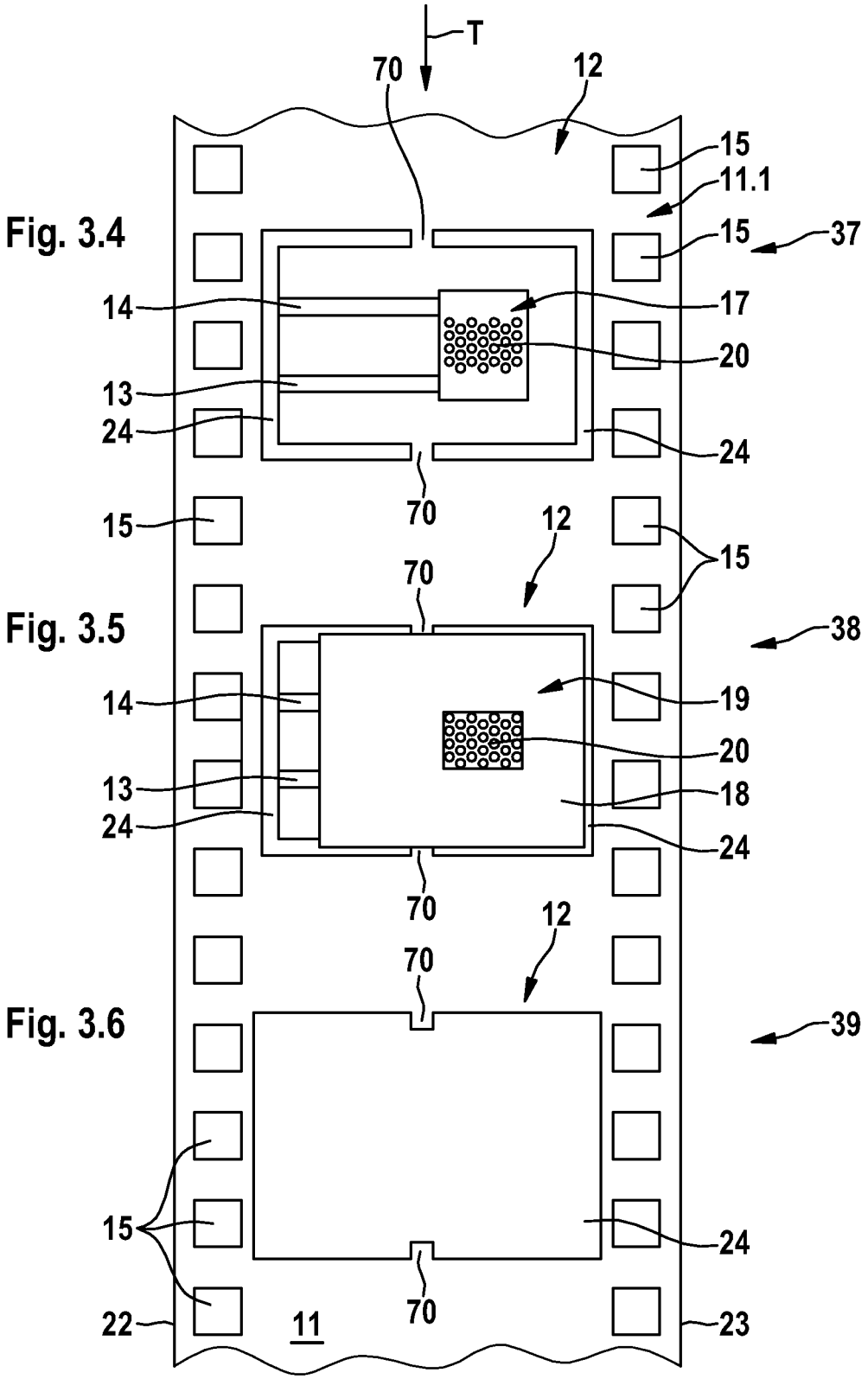
Fig. 3.4
Fig. 3.5
Fig. 3.6

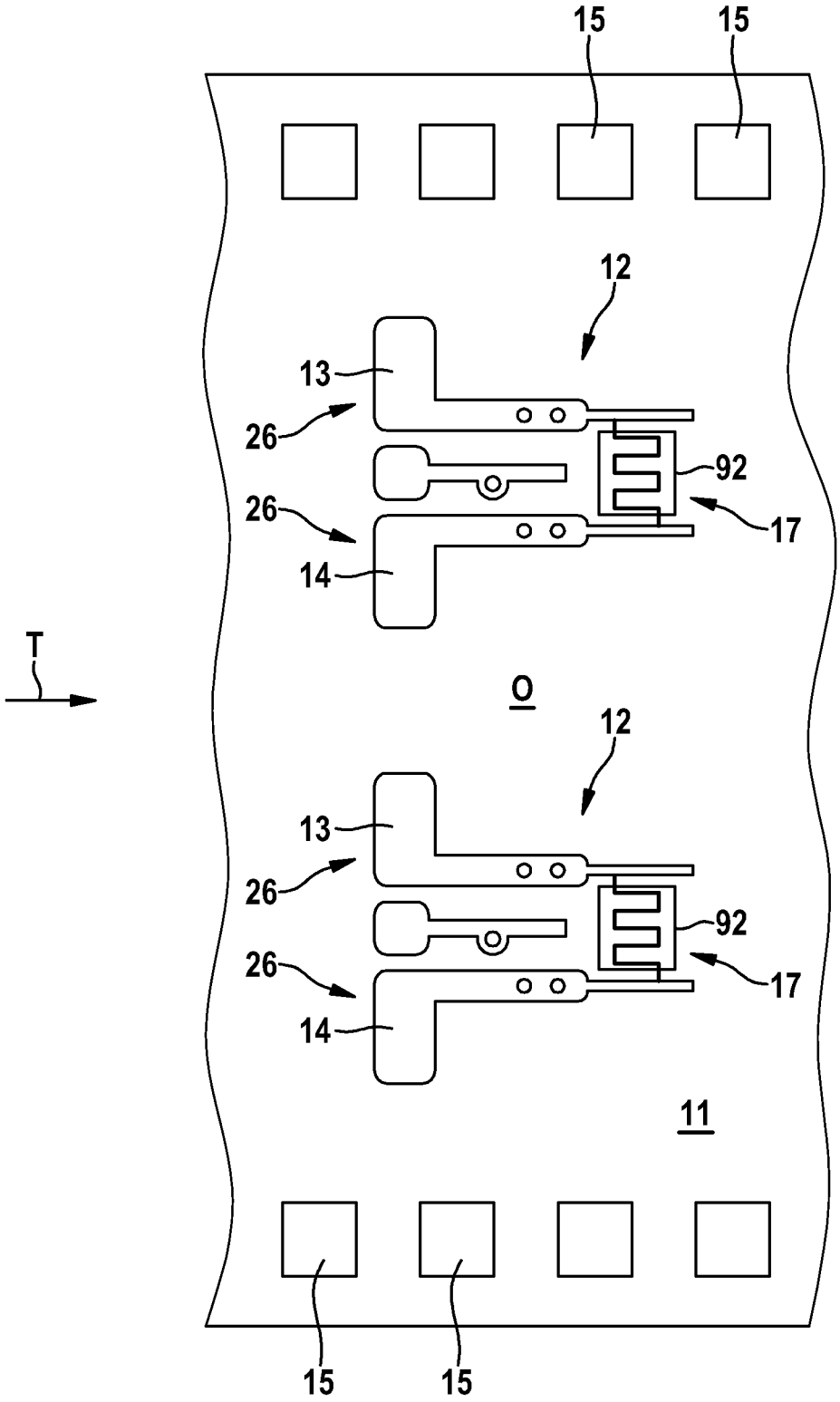
Fig. 5.1

VAPORIZER UNIT FOR INHALER AND METHOD FOR PRODUCING VAPORIZER UNITS

CROSS-REFERENCE TO RELATED APPLICATIONS

This application is a Continuation in Part application of German patent application 10 2019 135 177.4 filed Dec. 19, 2019, the entire contents of which is incorporated herein by reference.

FIELD OF THE INVENTION

The invention relates to a method for producing vaporizer units as a component of inhalers.

The invention furthermore relates to vaporizer units, vaporizer assemblies and vaporizer cartridges as a component of inhalers.

The invention also relates to inhalers, formed and configured for inhaling vapour/aerosol enriched with active ingredients and/or flavourings.

BACKGROUND OF THE INVENTION

Such vaporizer units, vaporizer assemblies, vaporizer cartridges and inhalers are used in the luxury goods/stimulants industry, here in particular in the context of an electronic cigarette, what are known as E-cigarettes, and in the medical sector in order to be able to inhale liquid luxury goods/stimulants and/or liquid medical products in vapour form and/or as aerosols. During consumption, a person normally sucks on a mouthpiece of the inhaler, as a result of which a suction pressure arises in an air flow channel, which suction pressure generates an air flow through the air flow channel. The air flow can, however, also be generated by machine, for example, by a pump. In the air flow channel, a liquid which is generated by the vaporizer unit and provided in a vaporised form is added to the air flow in order to administer an aerosol or an aerosol-vapour mixture to the consuming person. The liquid is stored at or in the vaporizer cartridge. Various mixtures with various components of the same or different vapour densities are used as the liquid. A typical mixture for use in an E-cigarette has, for example, components of glycerine and propylene glycol, where applicable, enriched with nicotine and/or almost any desired taste and/or flavouring agents. The mixture can correspondingly have medical components and active ingredients for use in the medical or therapeutic sector, i.e., for the inhalation of asthma preparations.

The vaporizer unit which is normally a single-use item or component of a single-use item is of central importance in the inhaler. An increasing trend is apparent for the use of such vaporizer units which leads to the vaporizer units, vaporizer assemblies and vaporizer cartridges and inhalers being produced in very large numbers in particular when the vaporizer assemblies and/or vaporizer cartridges with the vaporizer units are formed as single-use items. In other words, the vaporizer units are a mass-produced product. The previously known methods for the production of vaporizer units are only suitable to a limited extent to produce large numbers of items quickly and efficiently in order to be able to mount them en masse quickly and efficiently in vaporizer assemblies and vaporizer cartridges or be able to produce inhalers from them.

The vaporizer unit is a component of the vaporizer assembly. The vaporizer assembly is a component of the vaporizer cartridge. The vaporizer cartridge forms the inhaler together with a cartridge carrier and a mouthpiece. The individual components of the vaporizer cartridge, namely at least one hollow body, a supply tank and the vaporizer unit, can be combined in a joint component, wherein this component is then a single-use item which is designed for a finite number of inhalation draws by a consuming person and forms an inhaler together with a cartridge carrier as a reusable multi-use item which comprises at least one electronic control unit and an energy source. The vaporizer cartridge can, however, also firstly be formed by the joining together of several components, wherein individual components, namely in particular the hollow body and the vaporizer unit, are arranged in the cartridge carrier as multi-use items, and the supply tank as a separate component forms the single-use item. Ultimately, the inhaler can be used variably by replacing the single-use item which normally contains the liquid.

The single-use item and the multi-use item are correspondingly connected detachably to one another. The cartridge carrier as a multi-use item normally comprises at least one electronic control unit and an electric energy source. The energy source can be, e.g., an electrochemical single-use battery or a rechargeable electrochemical battery, e.g., a lithium ion or lithium polymer battery, by means of which a heating element is supplied with energy via electric contacts of the vaporizer unit. The electronic and/or electric control unit serves to control the vaporizer unit within the vaporizer cartridge. The cartridge carrier can, however, also comprise components of the vaporizer cartridge. The single-use item can be formed as a plug-on part so as to be capable of being plugged onto the multi-use item or as an insertion part so as to be capable of being inserted into the multi-way item. Instead of a plug connection, screw connections, snap connections or other quick connections can also be used. A mechanical and electric coupling for the formation of a functionally ready inhaler is produced with the connection of a single-use item and a multi-use item.

A component which ultimately determines the use (e.g., as an E-cigarette or as a medical inhaler) is the supply tank as a component of the vaporizer cartridge. This generally includes the liquid selected, desired and/or required by the person or a liquid mixture (also referred to below in general as a fluid) as well as the hollow body which forms the air flow channel and the vaporizer unit. The fluid is stored in the supply tank of the vaporizer cartridge. The fluid is conducted by means of the liquid-permeable—as a result of microchannels—vaporizer unit out of the supply tank due to at least initially capillary conveying through a wick element and to the heating element. The voltage generated by an energy source and applied to the heating element leads to a flow of current in the heating element. As a result of the heating resistance, preferably the ohmic resistance of the heating element, the flow of current leads to a heating of the heating element and ultimately to a vaporisation of the fluid located in the vaporizer unit. The vapour and/or aerosol generated in this manner escapes from the vaporizer unit in the direction of the air flow channel and is mixed with the air flow as additional vapour. The fluid thus has a predefined track with a predefined direction of flow, namely as a fluid through the wick element to the and through the heating element and in a gaseous form out of the heating element into the air flow channel. In the air flow channel, the vaporised fluid is carried along by the air flow, wherein vapour/mist and/or aerosol are formed if the air flow channel is acted upon with a pressure/vacuum in that, e.g., a consuming person sucks on the air flow channel or a pump conveys an air flow through the air flow channel.

So that the fluid does not flow out of the supply tank directly into the air flow channel, the vaporizer unit completely covers the access from the supply tank to the air flow channel. Completely covered means in this context that the liquid is necessarily guided through the vaporizer unit so that the fluid cannot travel directly from the supply tank into the air flow channel, but rather must take the "detour" via the wick element and the heating element. The wick element serves on one hand the purpose of interim storage of fluid in order to still make available sufficient fluid for a few draws on the inhaler in particular in the case of an almost empty supply tank. The wick element serves on the other hand in particular to transport the fluid from the supply tank in the direction of the air flow channel and acts simultaneously as a type of non-return protection in order to suppress the return flow of fluid and/or gas or vapour in the direction of the supply tank and prevent an accumulation of individual components of the fluid at higher temperatures.

Known methods for producing vaporizer units provide that heating elements, e.g., components having substantially silicon or doped silicon, are connected by means of direct contacting electrically to conductor paths on a ceramic substrate in such a manner that the heating element covers a passage opening located in the ceramic substrate. This method is only suitable to a limited extent for mass production. Vaporizer units produced in such a manner are problematic on one hand in terms of the imperviousness—with the exception of the micro-channels in the heating element—of the passage opening, and on the other hand during mounting of the vaporizer unit with components of the inhaler which surround the vaporizer unit. In order to ensure that neither liquid enters into the air flow channel nor liquid runs out of the vaporizer cartridge or the inhaler, additional sealing means, e.g., in the form of sealing rings or the like are necessary. This leads to a plurality of individual parts with correspondingly narrow tolerances so that mounting of the vaporizer units produced with the known methods is complicated and expensive, since automation of production is to some extent very complex and therefore complicated and technically difficult.

In further known methods for producing vaporizer units, metallic punch strips around which plastic is sprayed are fitted with heating elements. The heating elements are prefixed and then an electric contacting of the heating elements with conductor paths of the punch strips is performed, e.g., by means of wire bonding. This method is on one hand complicated and thus expensive since an automated sequence of steps can be carried out with standardised processes only in adapted apparatuses/machines. In the case of the vaporizer units manufactured in such a manner, the sealing problem furthermore exists since with components of the inhaler which surround the vaporizer unit, several such components have to be sealed off with respect to one another with additional sealing means as a result of the variety of parts in particular during mounting of the vaporizer units. As a result of this, the mounting of the vaporizer units produced with the known methods is complicated and expensive.

As known to those of skill in the art, while the above discusses features and structures that may be known, certain uses and combinations disclosed hereinbelow nonetheless may be novel and non-obvious.

SUMMARY OF THE INVENTION

The object on which the invention is based is thus to propose an efficient method for mass production of vaporizer units which are mounting-friendly and optimised in terms of sealing properties. The object further lies in creating mounting-friendly vaporizer units, vaporizer assemblies, vaporizer cartridges and inhalers which can be produced in an automated and efficient manner as mass-produced articles and have optimised sealing properties.

This object is achieved by the method with the following steps: a) providing a flexible circuit board material with a plurality of sites for individual vaporizer units, wherein the flexible circuit board material is optionally pre-structured at least with conductor paths and/or pre-punched areas predetermined in terms of position and/or course for each site, b) providing and placing at least one heating element which is optionally connected or can optionally be connected electrically to the conductor paths at the or each site, and c) at least partial covering of each site with a sealing material for the formation of a partial sheathing for each formed vaporizer unit, wherein the sealing material is applied in such a manner that the sheathing formed from sealing material covers each heating element while keeping open a heating surface at least on an upper side of the flexible circuit board material at least in an edge region, and at least the outer surfaces of the sheathing pointing away from the circuit board material and/or the heating element form sealing surfaces. The production of vaporizer units as mass-produced articles is ensured without additional development of special machines or the like with this sequence of steps. The sequence of steps can be performed at least in a partially automated manner, preferably, however, in a fully automated manner above all from delivery of the individual parts up to the installation-ready evaporator unit within a production line composed of known apparatuses/machines. As a result, the logistics requirements are restricted in a cost-saving manner merely to the supply of individual parts, such as flexible circuit board material and heating elements and sealing material, and the transporting away of the produced vaporizer units.

The flexible circuit board material is an expedient carrier material and enables an energy-saving design of the conductor paths with a conductor cross-section which can be configured almost as desired. In particular, as thin as possible and as narrow as possible conductor path cross-sections can be provided for optimised energy efficiency. The use of the flexible circuit board material and its provision also enable, in contrast to the provision of ceramic or the punch scrap sheathed with plastic as the carrier material, small contours for conductor paths and/or pre-punched areas and provide a wide range of contacting possibilities of the conductor paths free from process-related restrictions, such as exist, for example, in the punch scrap process. For example, the circuit board material can have polyimide in the form of a film or be composed thereof.

Pre-punched areas in the sense of the invention are holes, gaps, clearances, passages or the like in the circuit board material which connect the upper side to the lower side. Examples of pre-punched areas are, e.g., circumferential separating gaps only interrupted by connecting webs or openings which form passage openings at each site. A connecting location which forms the basis for a vaporizer unit to be produced is referred to as a site. A connecting location is a region on the circuit board material which can be separated/isolated after the completion of the rest of the circuit board material and as a result forms an individual vaporizer unit. The several sites on a roll are preferably formed to be identical and thus form what are known as continuous strands/belts. The sites can be arranged/formed individually consecutively and/or in two or more rows next to one another, uniformly or offset from one another or in another manner on such a belt. For example, the sites can be arranged in a chessboard-like pattern or in a hexagonal pattern. The electric conductor paths and pre-punched areas are predefined and pre-structured for each site, and indeed depending on the configuration of the vaporizer units to be produced in each case. In other words, the flexible circuit board material is prefabricated. Prefabrication can also comprise the heating elements in that a heating element is integrated at each site instead of a pre-punched area as a passage opening for a heating element to be placed separately in the circuit board material, which heating element is connected electrically to the conductor paths. In this event, steps a) and b) coincide since the heating elements are also provided simultaneously with the provision of the flexible circuit board material. The connection of the heating element to the conductor path can already exist, e.g., in the case of a heating element integrated into the circuit board material as a film heater. Such a heating element can be liquid-permeable or become liquid-permeable, e.g., through a micro-structuring. The connection can, however, also only be formed, e.g., in the case that the heating element is placed on the conductor paths. Such a heating element can advantageously already have micro-channels.

Alternatively or additionally, the electric conductor paths can be applied prior to the provision and placing of the heating element onto the circuit board material. This can occur, for example, with a process which is similar to colour printing, e.g., polyjet, screen printing or stamp printing, or targeted vaporisation. Any other suitable and known process is, however, also conceivable. In other words, the circuit board material is prefabricated or prestructured by this step. Alternatively or additionally, pre-punched areas are also incorporated into the circuit board material prior to or after the provision and placing of the heating element. For example, pre-punched areas can be incorporated via suitable punching tools or other cutting and boring tools. In other words, the circuit board material is prefabricated or pre-structured by this step. The sequence of the application of conductor paths and the introduction of pre-punched areas can be carried out independently and thus consecutively in any desired sequence or simultaneously.

In the event that the heating elements are not an integral component of the flexible circuit board materials, but rather in step b) are provided as structural elements/heating chips to be fitted separately, the placing of the or each heating element comprises, e.g., by means of suitable SMT pick-and-place machines the receiving and outputting of each heating element which can be, e.g., a heater chip composed significantly of silicon comprising a sawn wafer composite or also a film heating element above the or each pre-punched area formed in the circuit board material as a passage opening. For the electric connection of the fitted heating elements to the conductor paths, see further below. The providing and placing of the heating element on the or each site comprises in the sense of the invention, e.g., also the provision and placing at every second site in so far as this is desired or necessary, or only at fault-free sites. The term at each site therefore does not mean anything other than at any desired, predefined site.

In step c) at least the or each heating element is partially enclosed, e.g., with suitable silicons, plastics, polyimide, rubber or other materials which are suitable as sealing material, for example, by means of what is known as the Film-Assisted-Moulding method. It is also conceivable that the sealing material has a multi-layer structure from any desired combination of the above-mentioned materials and is produced by multiple use of the Film-Assisted-Moulding method with in each case a different or the same above-mentioned materials from the list. Regions of the heating element, namely in particular the heating surface, are partially recessed. On one hand, an (additional) mechanical retention of each heating element is formed with the formation of the sheathing. On the other hand and particularly advantageously, sealing surfaces are simultaneously created with the sheathing. Reliable sealing surfaces adapted to desired or necessary contours can particularly advantageously be achieved as a result of the at least partial covering by at least partially spraying or moulding of the site with sealing material. The sealing surfaces/seals integrated in the vaporizer unit, preferably with a defined sealing surface, can reduce the number of components required, such as, e.g., additional sealing means, during mounting to an inhaler. As a result of this, the mounting is simplified and the automation of the process is optimised. A further advantage of the at least partial covering of each site with the sealing material lies in the fact that, as a result of the shaping of the sheathing, surrounding geometries of the vaporizer unit, e.g., for air and/or liquid guidance are included in the vaporizer unit, namely are an integral component of each vaporizer unit. Due to the fact that the sealing material is applied in step c), a sharp delimitation to the heating surface of the heating element can also be achieved so that an effective sealing directly to the active heating surface, i.e., the active passage region for liquid from a tank, is achieved. In step c), optionally only the upper side which bears the heating elements is provided with the sealing material. The lower side of each vaporizer unit can be delimited free from sealing material by the circuit board material.

Flexible circuit board material is preferably provided in step a), in the case of which at least one site for an RFID chip is formed in the region of each site for a single vaporizer unit, wherein the flexible circuit board material is prestructured in terms of position and/or course of predetermined conductor paths as an RFID antenna. A high degree of integration is thus achieved in that installation space which is present in any event on the circuit board material is used to improve the functionality of each vaporizer unit obtained therefrom without changing the installation space and without negatively influencing the efficiency during mass production. The predetermined conductor paths as RFID antenna ultimately form at least one coil, wherein transmission and receiving coils can be formed separately from one another, preferably in parallel planes to one another with a small spacing, or can be formed integratively as a joint transmission and receiving coil. The preferred further development also enables in particular a modular product concept in the case of which optionally a heating element and/or an RFID chip can be integrated.

In one advantageous further development, the flexible circuit board material is optionally pre-structured at least with conductor paths and/or pre-punched areas predetermined in terms of position and/or course for each site for electronic connection at least of the RFID chip. As a result of this, the connections and/or the antenna itself are already provided and incorporated during the structuring process of the circuit board materials, which ensures particularly compact and efficient production of the vaporizer units.

An RFID chip is preferably provided and placed at each site in a step k) which can be carried out prior to, with or after step b). This is performed in the event that the or each RFID chip is not an integral component of the flexible circuit board material, but is rather provided in step k) as a structural element to be fitted separately. For example, NFC components can be provided and placed as an RFID chip. Other short-distance radio modules can, however, also be used. The or each RFID chip can itself have an antenna in order to be able to communicate with the or each RFID antenna. The placing of the or each RFID chip is performed, e.g., by means of suitable SMT pick-and-place machines, just like the receiving and outputting of each RFID chip. For the electric connection of the fitted RFID chips to conductor paths, see further below.

As mentioned, the RFID chip can be an integral component of the circuit board material. Optionally, the separate RFID chip is provided, placed and connected electrically to the conductor paths, wherein the RFID chip at each site is optionally connected or can optionally be connected to the conductor paths which form the RFID antenna. The connection can be performed electrically or via wireless signals.

In order to protect the RFID chip, in particular from moisture, the site for the RFID chip is also optionally covered with the sealing material with the formation of sealing surfaces in step c) additionally for partial covering of each site for the heating element.

The provision of the flexible circuit board material in step a) is preferably optionally performed by rolling out the circuit board material stored on rolls or by supplying portions of the circuit board material stored in magazines or the like. The rolls with flexible circuit board material can be stored in a space-saving manner and enable rapid provision of the sites in large numbers by simple rolling out/unwinding. The same applies to the supply of portions of the circuit board material from magazines or the like.

In step c), each site is advantageously enclosed at least partially with sealing material in such a manner that sealing surfaces for an existing connection free from additional sealing means to the components of the inhaler surrounding the vaporizer unit are additionally formed both on the upper side and on a lower side, opposite the upper side, of the flexible circuit board material on the outer surfaces of the sheathing. The formation of additional, preferably defined, sealing surfaces in particular on the lower side of the circuit board material can also be performed prior to/during/after the application of the sealing material onto the upper side. The vaporizer unit can thus be mounted in a particularly easy and particularly sealing manner, e.g., into standardised vaporizer assemblies or the like.

As described further above, the heating elements can also be formed as separate structural elements. In this event, it is particularly advantageous that step b) comprises: as step b1) the application of electric contacting material at least on contact surfaces of the conductor paths at each site on the upper side of the flexible circuit board material; as step b2) the placing of the at least one heating element in the region of each site in such a manner that a pre-punched area which connects the upper side to the lower side of the circuit board material is fully or partially covered by the or each heating element; and as step b3) the formation of an electric connection between the heating element and the conductor paths at each site.

As described further above, the RFID chips can be provided as separate structural elements. Step k) optionally comprises: as step k1) the application of electric contacting material at least on contact surfaces of the conductor paths at each site for the RFID chips on the upper side of the flexible circuit board material; as step k2) the placing of the at least one RFID chip in the region of each site; and as step k3) the formation of an electric connection between the RFID chip and the conductor paths at each site. In further embodiments or preferred further developments, electric contacting material can also be applied onto the contacts of the RFID chips. Concretely, for example, anisotropically conductive adhesive can be applied onto the lower side of the chip in the region of the contacts, wherein the chips prepared in such a manner are placed onto the conductor paths of the flexible circuit board material.

The application of the electric contacting material, which can be, e.g., soldering paste, solder, sinter paste, electrically conductive adhesive material or the like or a combination of one or more of the above-mentioned contacting materials, can be performed by means of suitable methods. Examples of suitable methods are screen printing, stencil printing, pad printing, dispensing or the like or a combination of one or more of the above-mentioned methods. These methods are performed with the aid of suitable apparatuses. One example of a suitable apparatus is a screen-printing machine.

The placing of the heating element and also of the RFID chip can preferably be performed with an SMT pick-and-place machine or the like. The formation of the electric connection can be performed, e.g., by transforming the contacting material, e.g., by heat and/or pressure in a furnace, a sintering press, contact thermodes or the like or a combination of one or more of the above-mentioned variants. Wiring by means of what is known as wire bonding is also optionally possible in step b3). As a result of the adaptation of the manufacturing process of the vaporizer units to standardised manufacturing processes and manufacturing device, in particular in step b), on one hand mass production of vaporizer units is ensured, and on the other hand capacity bottlenecks which can arise when using special methods/special machines are reliably avoided.

It is also conceivable that what is known as the nanowiring method is used for electric contacting of the heating element. In the case of the nanowiring method, nanowires are grown on a surface. The nanowiring method is a galvanic process which is similar to pad printing. In this case, a pad which bears an electrolyte is pressed onto the substrate. A metallic lawn with diameters of a few nanometres to a few micrometres and lengths of a few hundred nanometres to a few tens of micrometres grows into the porosity layer of the pad. The substrates are only coated in the provided regions with nanowiring coating by a structuring process (also referred to as masking). Finally, during the stripping process, all of the materials which are not required for the connection are removed and cleaning of the substrate is performed. As a result of the galvanic process, it is possible to produce the nanowires from practically any galvanically separable metal. For example, copper, gold or nickel can be used for the production of the nanowiring coating.

In the case of what is known as KlettWelding, two substrates are prepared by means of the nanowiring method, i.e., the portions of the conductor paths on the circuit board material and portions on the heating element are connected in each case to a nanowiring coating and thus provided with nanowires are connected by compression (e.g., with 20 MPa) at room temperature. This force can be applied as a function of the component size by commercially available pick-and-place machines or flip chip bonders. Large surface area connections are produced with electric or hydraulic motors. The use of simple knee lever presses is also possible. As a result of their small diameters, the individual wires are connected instantaneously mechanically and additionally at an atom lattice level—similar to cold welding. The resultant connection has comparable electric—and thermal—characteristic data to rolled copper, alongside simultaneously high mechanical strength.

It is also conceivable that the electric connection is performed by means of what is known as the KlettSintering process. In this case, only one substrate, i.e., either the circuit board material or the heating element, has a nanowiring coating. The second substrate, i.e., either the heating element or the circuit board material, requires a copper-plated or gold-plated surface. Both substrates are compressed (e.g., with 20 MPa) and a temperature in the range of 210° C. is introduced into the connection zone, e.g., via a thermode. The same also applies to the electric contacting of the RFID chip.

In one preferred further development of the method, after step c), the sprue portions of the sealing material generated during covering or enclosing of the sites with sealing material are removed in a step d). Each site or the vaporizer unit formed thereon—with the exception of at least one connecting web—is thus released or separated from the circuit board material and all further connections which are not a component part of a vaporizer unit. It is, however, also conceivable that the release or separation of the sprue portions is performed simultaneously in the case of an isolation of the vaporizer units from the belt from the circuit board material.

Preferably, after step c) or d), the circuit board material provided with the plurality of finished, sealing vaporizer units can, for further use, in a step e) be optionally rolled back onto a roll or collected in a magazine or the like. Rolling up/collection can also already be performed after step b) in particular from the time of permanent connection between the heating element and the circuit board material. Further use can be storage, intermediate storage or further processing. As a result of the intermediate rolling up/collection of the circuit board material produced in steps a) and b) or a) to c) or d) with vaporizer units generated thereon, a space-saving, effective mass production of vaporizer units is actively supported. For example, complete rolls or magazines or the like can be supplied with a plurality of vaporizer units so that mass mounting of the vaporizer units is subsequently enabled after completed isolation at any desired location.

To prepare mounting of the vaporizer units, the sealing vaporizer units are isolated from the flexible circuit board material for further use in a step f). Isolation can be performed, e.g., preferably by punching from the circuit board material in that the or each remaining connecting web to the circuit board material is separated. The vaporizer units can also be separated fully from the circuit board material, i.e. without entirely or partially circumferential pre-punched areas. Sawing or cutting are also options for isolation. The isolated vaporizer units can then be further processed as trayware or bulkware or directly be further mounted.

To complete the vaporizer unit, at least one wick element can be placed in a step g) on or at the upper side of the flexible circuit board materials on the free heating surfaces of the heating elements at each site. The wick element is preferably mounted on or at an upper side (O) of the circuit board material. The wick element can be placed on the free heating surface in particular in the case of a one-piece formation, e.g., by means of SMT pick-and-place machine. The wick element can also be configured as a granular wick element and be poured for mounting. A granular wick element is at least partially formed from a plurality of granulate-like grains which form micro-channels as a result of their pouring and/or formation. In the event that the wick element is already formed in combination with the heating element, the heating element therefore simultaneously the wick element or the heating element at and/or on the heat surface has a wick element, the wick element is also simultaneously placed by the placing of the heating element. The wick element can correspondingly be placed in any desired sequence of steps together with step b) or after step b). During placing after step b), the or each wick element can still be placed prior to step c) or after step c). For fixing each wick element, it can, e.g., be placed/pushed/mounted/fixed into a recess/pocket formed by the sealing material or the like after step c). The wick element can also be placed after step c) on the free heating surface and fixed by pushing into a receiver, e.g., formed in a component of a vaporizer assembly. The time of fitting/placing the wick elements can ultimately be selected almost as desired. Even the placing of the wick element after isolating the vaporizer units from the circuit board material is possible.

In one preferred further development of the method, at least one additional electronic component can be placed in the region of each site in a step h), preferably together with step b2) and k2). The electronic component is, for example, an ID chip which serves as a characterising element for unique identification of the respective vaporizer unit and as an NFC element, RFID element or as a digital memory chip (e.g., EEPROM). The or each ID chip can optionally also be connected to an antenna, for example, an NFC antenna or an RFID antenna. Various options are possible in terms of the position of the or each ID chip on the site. It is also possible to position the additional components, instead of the ID chip or in addition to the ID chip, sensors and other electronic components can be placed, not only on the upper side, but also on the lower side in the region of corresponding electric contact surfaces. The ID chip and any other component can also be at least partially covered or enclosed by the sheathing. The covering/enclosing can be performed with the sealing material with which the heating element is also covered/enclosed in particular when the electronic component is placed prior to step c). The covering/enclosing can, however, also be performed in a separate step with the same sealing material or a second material, in particular a sealing material.

Preferably, prior to step h), and particularly preferably together, therefore simultaneously with step b1) and k1), contacting material can be applied on contact surface of the conductor paths at each site on the upper side and/or the lower side of the flexible circuit board material, and after step h), preferably together, therefore simultaneously with step b3) or k3), an electric connection is formed between the or each electronic component and conductor paths at each site. The production machine used for the heating elements can correspondingly be used.

Each heating element and/or each RFID chip and/or each additional electronic component is particularly preferably connected electrically to the conductor paths of the flexible circuit board material by using one or more methods from the list: direct contacting by means of silver sintering, eutectic bonding, conductive gluing, anisotropically conductive gluing, KlettWelding, KlettSintering, soldering, welding. As a result of this, particularly good contacting to the conductor paths is achieved, with sufficient thermal insulation.

Optionally, at least portions of an air flow channel are formed in step c) during covering or enclosing of each site from and/or with the sealing material on the lower side of the circuit board material at each site. The formation of the portions of the air flow channel can also be performed prior to step c) and after step c), and indeed by the sealing material with which the heating element is also covered/enclosed or with a second sealing material. This embodiment leads to what is known as an "open" variant since the air flow channel only becomes a continuous air flow channel which is closed on the circumferential side in combination with components surrounding the vaporizer unit.

In a further option, a tubular, prefabricated portion as part of an air flow channel is placed on the lower side of the circuit board material and enclosed by means of additional sealing material and thus fixed at each site. This embodiment leads to what is known as a "closed" variant since the vaporizer unit itself comprises a continuous portion of the air flow channel which is closed on the circumferential side.

At least steps a) to c) are particularly preferably carried out consecutively in each case at a separate or the same production station of a production line in such a manner that a plurality of sites are processed simultaneously in each step. As a result of this, a high degree of automation for rapid and efficient series production with highly optimised parts logistics is ensured.

The entire production process of the vaporizer units is particularly preferably carried out in a joint production line with several production stations, as a result of which the above-mentioned advantages are yet further supported.

In one preferred further development, the flexible, prestructured circuit board material which is preferably composed of polyimide is unwound as a continuous strand from a supply roll and continuously or intermittently transported through the production line which comprises several production stations. It is thus possible, for example, to roll out the continuous strand so that, e.g., at a first production station step b) is carried out at a plurality of sites for a plurality of vaporizer units. After the completion of step b), the continuous strand can be transported further in order to transport a subsequent portion of the continuous strand for the carrying out of step b) into the region of the first production station. For example, the leading portion which has already undergone method step b) can then optionally be located in a second production station for carrying out step c). This process sequence can be carried out continuously up to step h) and including step k). All of the production steps can thus be performed preferably in an entirely automated manner with the aid of a production line. The method can correspondingly also be carried out in that portions of flexible circuit board material are supplied with one site or several sites, e.g., in magazines, cassettes or the like and are transported with or without a magazine or the like through the production line.

The object is also achieved by a vaporizer unit mentioned hereinbefore which is characterised by a circuit board portion composed of flexible circuit board material, wherein the circuit board portion comprises at least two conductor paths and a passage opening which connects an upper side of the circuit board portion to a lower side of the circuit board portion, at least heating element which fully or partially covers the passage opening from the upper side and is in electric contact with the conductor paths, as well as a sheathing composed of sealing material which at least partially covers the circuit board portion and the heating element while keeping open a heating surface and is provided towards the outside with sealing surfaces. The flexible circuit board material of the circuit board portion offers, in addition to the possibility of mass production, a particularly energy-efficient formation of the cross-section of the conductor paths. As a result of the sheathing of the heating element composed of sealing material, this is on one hand reliably secured mechanically and on the other hand the preferably defined sealing surfaces pointing to the outside, i.e. away from the heating element, lead to the vaporizer unit including overall a double function, namely on one hand as a vaporizer and on the other hand as sealing means such that mounting with a reduced number of parts is ensured with the vaporizer unit according to the invention with integrated sealing means. Overall, an energy-efficient and reliable vaporizer unit which is suitable for mass production is created by the formation according to the invention.

The circuit board portion advantageously comprises at least one RFID chip and at least one RFID antenna. The or each RFID chip and the or each RFID antenna are thus an integral component of the carrier substrate and thus of the vaporizer unit itself so that contactless transmission of data, e.g., between the vaporizer unit or a vaporizer cartridge comprising the vaporizer unit and a cartridge carrier or between the vaporizer unit or an inhaler comprising the vaporizer unit and a read-out device, such as, e.g., a smartphone, is ensured in a compact and efficient manner. Typical data which can be transmitted are, e.g., data for correct vaporisation, to authorise the user of the inhaler, to activate the vaporizer cartridge or to track the usage behaviour by the user himself or herself and/or a doctor or pharmacist in particular for medically used inhalers.

The circuit board portion is advantageously formed from polyimide, a doped silicon chip with microchannels is connected as a heating element by direct contacting by means of silver sintering electrically to the conductor paths, and the circuit board portion as well as the silicon chip are partially enclosed by silicon or polyimide so that on one hand the silicon chip is mechanically retained and on the other hand preferably defined sealing surfaces preferably towards the outside are formed. The sealing surfaces can be formed to be undefined. The sealing surfaces preferably, however, have predefined and reproducible, i.e. defined sealing surfaces. An alternative to silicon can be a suitable plastic or polyimide. The circuit board portion and silicon chip are furthermore enclosed by the sealing material in such a manner that liquid can be transported through the microchannels of the silicon chip from a first side of the silicon chip to a second side of the silicon chip. The advantages described above are even further amplified with this formation. As an alternative to the silicon chip, what is known as a film heater can also be used or provided as the heating element which has a microstructure by means of which liquid can be transported from a first side of the film heater to a second side of the film heater.

In a particularly preferred further development, the conductor paths embedded in the flexible circuit board material protrude out of the sheathing formed by the sealing material for the formation of a flexible contacting bendably, in particular reversibly and/or flexibly bendably. During and after bending, the conductor paths embedded in the circuit board material are electrically conducting and contact the silicon chip or the film heater or any other heating element. As a result, further contacting in particular into components surrounding the vaporizer unit, for example, of a vaporizer assembly or vaporizer cartridge, can be dispensed with, which further reduces the variety of parts and in particular enables highly simplified and space-saving mounting.

One expedient embodiment is characterised in that the heating surface of the heating element is covered on the upper side at least partially by a wick element. As a result of this, the vaporizer unit is completed for particularly efficient and reliable use.

One optional embodiment is characterised in that at least one tube portion as a portion of an air flow channel is formed and/or arranged on the lower side of the circuit board portion, wherein the tube portion has an opening directed towards the heating element. The tube portion can be formed from sealing material and/or a separate tube.

The vaporizer unit is particularly preferably produced with a method as described herein. The advantages which arise from this have already been explained above in conjunction with the production method, hence reference is made to the corresponding passages to avoid repetition.

The object is also achieved by a vaporizer assembly mentioned hereinbefore which is characterised by a vaporizer unit as described herein as well as an adapter plug into which vaporizer unit is plugged, wherein the vaporizer unit or its sheathing bears at least partially with an outer surface of the sheathing in a sealing manner against the inner geometry of the adapter plug. The inner geometry of the adapter plug designates here surfaces of a region in the adapter plug which is configured for receiving the vaporizer assembly. As a result of this formation of the sheathing in combination with the inner geometry of the adapter plug, there is a fluid connection exclusively via the vaporizer unit in the direction of the flow channel without additional sealing means. In other words, the vaporizer assembly is formed in a sealing manner with the exception of the vaporizer unit in the region of the heating surface for receiving liquid from a supply tank and generating vapour in the direction of an air flow channel.

The vaporizer assembly advantageously comprises at least one portion of an air flow channel which is formed by the vaporizer unit and/or the adapter plug. The adapter plug can have a separate portion of an air flow channel, wherein the air flow channel has an opening for a connection to the vaporizer unit. The air flow channel can, however, also be formed entirely by the vaporizer unit or partially by the vaporizer unit in combination, e.g., with a wall of the adapter plug or a portion of the inner geometry described above of the adapter plug.

The object is also achieved by a vaporizer cartridge mentioned hereinbefore which is characterised by a hollow body with at least one portion of an air flow channel, a supply tank for storing liquid, as well as a vaporizer assembly, wherein the vaporizer assembly is connected to the hollow body and the supply tank in a sealing manner such that the portion of the air flow channel of the vaporizer assembly and the portion of the air flow channel of the hollow body form a joint air flow channel and the supply tank has at least one access opening to the flow channel in which the vaporizer unit is placed.

The object is also achieved by an inhaler mentioned hereinbefore which is characterised by a cartridge carrier comprising at least one electronic control unit and one electric energy source as well as a vaporizer cartridge.

The advantages which arise in conjunction with the vaporizer assembly, the vaporizer cartridge and the inhaler have already been described in conjunction with the production method as well as the vaporizer unit, hence reference is made to the corresponding passages to avoid repetition.

BRIEF DESCRIPTION OF THE DRAWINGS

Further expedient and/or advantageous features and further developments as well as method steps will become apparent from the description and/or the drawing. Particularly preferred embodiments and the production method are explained in greater detail on the basis of the enclosed drawing. In the drawing:

FIGS. 1*aa*) to 1*bb*) are schematic views of the embodiment according to FIGS. 1*a*) and 1*b*), each supplemented by an RFID antenna and a further electronic component;

FIGS. 3.1) to 3.6) are schematic views showing a possible sequence of steps for carrying out a preferred method according to the invention on the basis of a continuous belt for processing at different production stations of a production line;

FIG. 5.1 is the schematic view according to FIG. 5 with a modified contacting in the region of the conductor paths;

DETAILED DESCRIPTION OF THE INVENTION

Figure 1A:
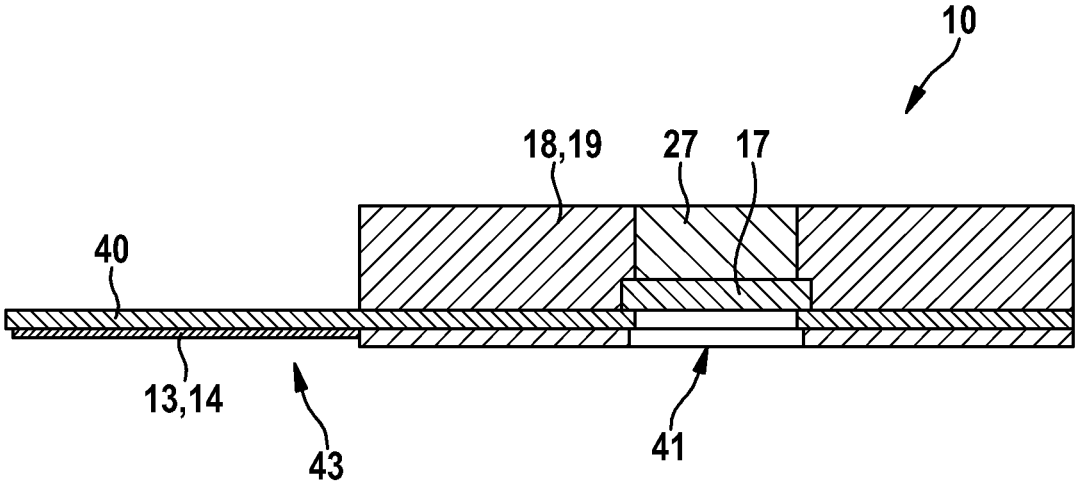
FIGS. 1*a*) to 1*b*) are schematic views of a first embodiment of a vaporizer unit according to the invention with projecting and bent-over flexible contacting.

The vaporizer unit represented in the drawing or the vaporizer assembly and vaporizer cartridge serve, when mounted to an inhaler, for the inhalation of vapour and/or aerosols enriched with active ingredients, e.g., nicotine, from liquid, and are described in the context of an E-cigarette. Other purposes of use, in particular also use in the medical sector, are expressly encompassed, since in particular the vaporizer units and the vaporizer assembly allow universal use since the standardised vaporizer unit or vaporizer assembly enables an integration/an installation in various vaporizer cartridges and/or various tank shapes.

As mentioned, and generally referring to all Figures, the method serves to produce vaporizer units 10 as a component of inhalers 100. The method can be carried out manually or semi-automatically in that, e.g., only individual method steps are performed in an automated manner. The method is, however, preferably formed for fully automated performance or production of vaporizer units.

The method is characterised according to the invention in that at least the following steps are performed in the defined sequence a) to c), namely a) providing a flexible circuit board material 11 with a plurality of sites 12 for individual vaporizer units 10, wherein flexible circuit board material 11 is optionally pre-structured at least with conductor paths 13, 14 and/or pre-punched areas 15, 16, 24 predetermined in terms of position and/or course for each site 12, b) providing and placing at least one heating element 17 which is or can be optionally connected electrically to conductor paths 13, 14 at the or each site 12, and c) at least partial covering of each site 12 with a sealing material 18 for the formation of a partial sheathing 19 for each formed vaporizer unit 10, wherein sealing material 18 is applied in such a manner that sheathing 19 formed from sealing material 18 covers each heating element 17 while keeping open a heating surface 20 at least on an upper side O of flexible circuit board material 11 at least in the edge region of the heating element 17, and at least the outer surfaces of sheathing 19 facing away from circuit board material 11 and/or heating element 17 form sealing surfaces 21.

The terms each or the or each site 12 also expressly encompass that, for example, only every second site 12 or only fault-free sites 12 are processed. Each desired or selected site 12 or site 12 to be produced is therefore meant. In the ideal case, in actual fact all sites 12 should be processed without exception for particularly high efficiency. In step a), the provision of circuit board material 11 can be performed in a different manner (see in this regard further below). Circuit board material 11 can already be provided in a pre-structured manner or still be pre-structured after the provision and prior to further processing, i.e., in the production process of vaporizer units 10. In step b), heating element 17 can already be connected, e.g., for the case that heating element 17 is a film heater, while heating element 17 can still be connected in the production method, e.g., for the case that heating element 17 is a silicon chip. The or each heating element 17 can be arranged on both sides of circuit board material 11, e.g., only on the upper side or only on the lower side, wherein the upper side and lower side are ultimately exchangeable since assignment is dependent on how circuit board material 11 is ultimately retained/transported or the vaporizer unit 10 formed thereon is ultimately mounted, or on both sides with a through-contacting. In the edge region 17.1 means that heating element 17 is sealed off circumferentially in such a manner that a fluid connection between upper side O and lower side U of circuit board material 11 adjacent to heating surface 20 is ruled out. An exemplary circumferential edge region 17.1 is schematically represented by a dotted line in FIG. 3.3, and in this example extends adjacent the perimeter of the heating element 17. The heating surface may be said to be surrounded by the edge region.

Figure 5:
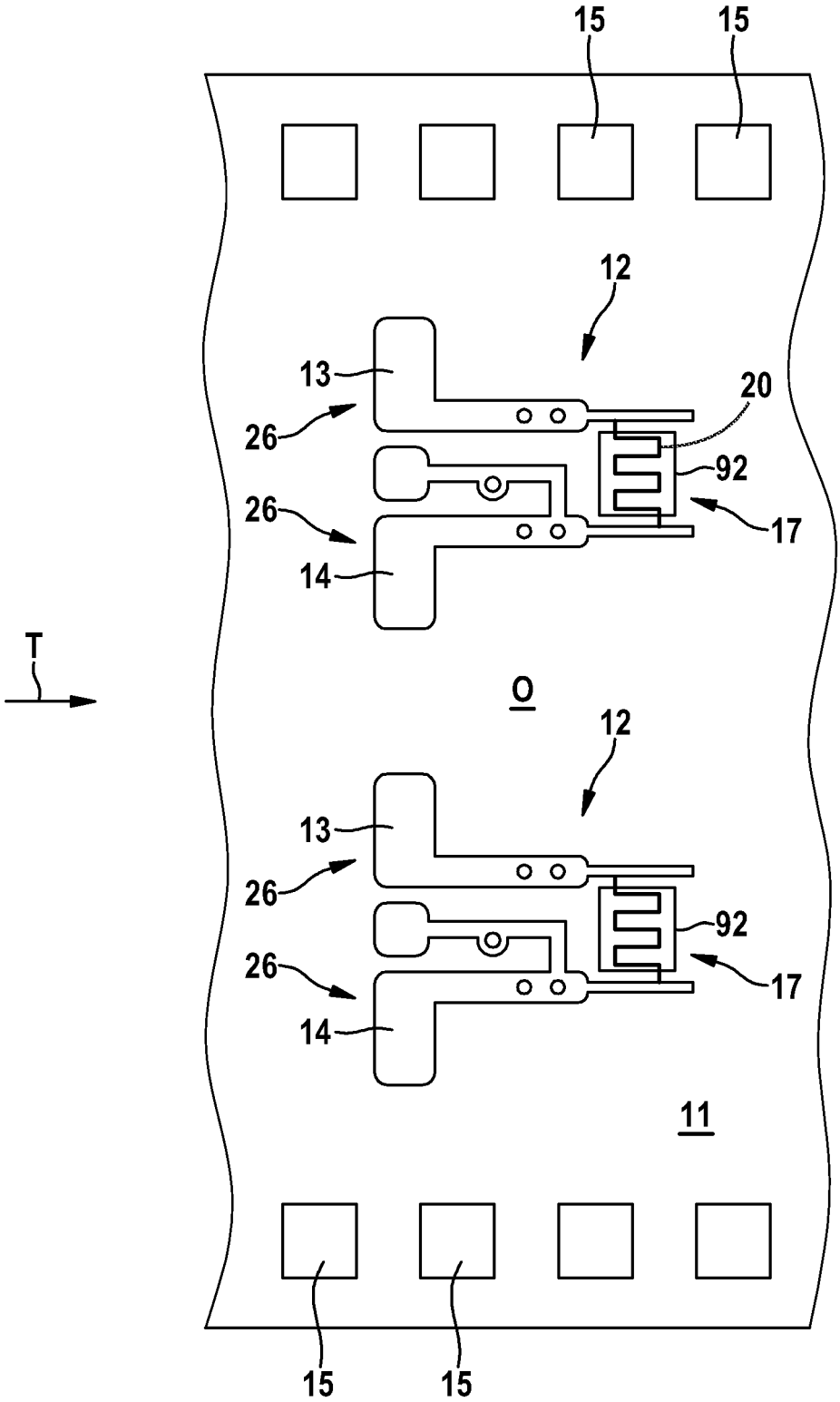
FIG. 5 is a schematic view showing an upper side of a portion of a first embodiment of the circuit board material with two sites having a heating element.

Flexible circuit board material 11 as a substrate can be, e.g., a single-web belt 11.1 (also referred to below as a continuous belt) (see in particular FIG. 3) or a multi-web continuous belt (see, e.g., FIGS. 5 to 7), which is stored on rolls or other storage containers, and for further processing is rolled off or unwound continuously or intermittently in a transport direction T. For transport of continuous belt 11.1, it has pre-punched areas 15 at least at a side edge 22, preferably, however, at both side edges 22, 23, into which punched areas transport means can engage, e.g., in the form of transport pins, drive wheels or the like. Flexible circuit board material 11 as a substrate can, e.g., also be divided or separated into portions comprising a site 12 or several sites 12, which portions are stored and supplied in magazines, cassettes or the like.

In addition to the transport-related pre-punched areas/recesses 15, circuit board material 11 can at each site 12 of a vaporizer unit 10 have further pre-punched areas 16, i.e. recesses or openings, and indeed in particular in such cases in which heating elements 17 to be fitted separately are used for vaporizer units 10. In these cases, pre-punched areas 16 at each site 12 serve as a passage opening 41 to enable a connection between a supply tank and an air flow channel via vaporizer unit 10, which is discussed in detail further below. For the case that heating element 17, e.g., as a film heater, is an integral component of circuit board material 11, a region 92 of a micro-structuring can optionally be provided which is formed in a liquid-permeable manner. Further pre-punched areas 24 serve to allow sealing material 18 to flow from the upper side to the lower side or vice versa. Pre-punched areas 24 can also serve to already pre-detach vaporizer unit 10 in portions from circuit board material 11.

Each site 12 also comprises at least two conductor paths 13, 14 for electric contacting of heating element 17. Both conductor paths 13, 14 and pre-punched areas 15, 16 which are assigned to circuit board material 11 at the or each side edge 22, 23 and each site 12 are pre-structured in such a manner that they are adapted to a predefined structure/a predefined layout of conductor paths 13, 14 and pre-punched areas 15, 16, 24 in a manner corresponding to vaporizer units 10 to be produced. Ultimately, the number of sites 12 on a continuous belt 11.1 can be as desired and vary in terms of arrangement/pattern, just as the layouts of sites 12 can vary. Preferably, however, all sites 12 on a continuous belt 11.1 are formed to be identical.

For the case that circuit board material 11 at each site 12 comprises a heating element 17 integrated into circuit board material 11 for the formation of a heating surface 20 (see, e.g., FIG. 5), the execution of step a) necessarily and simultaneously also leads to the execution of step b) so that at least a two-step method emerges in combination with step c).

Figure 6:
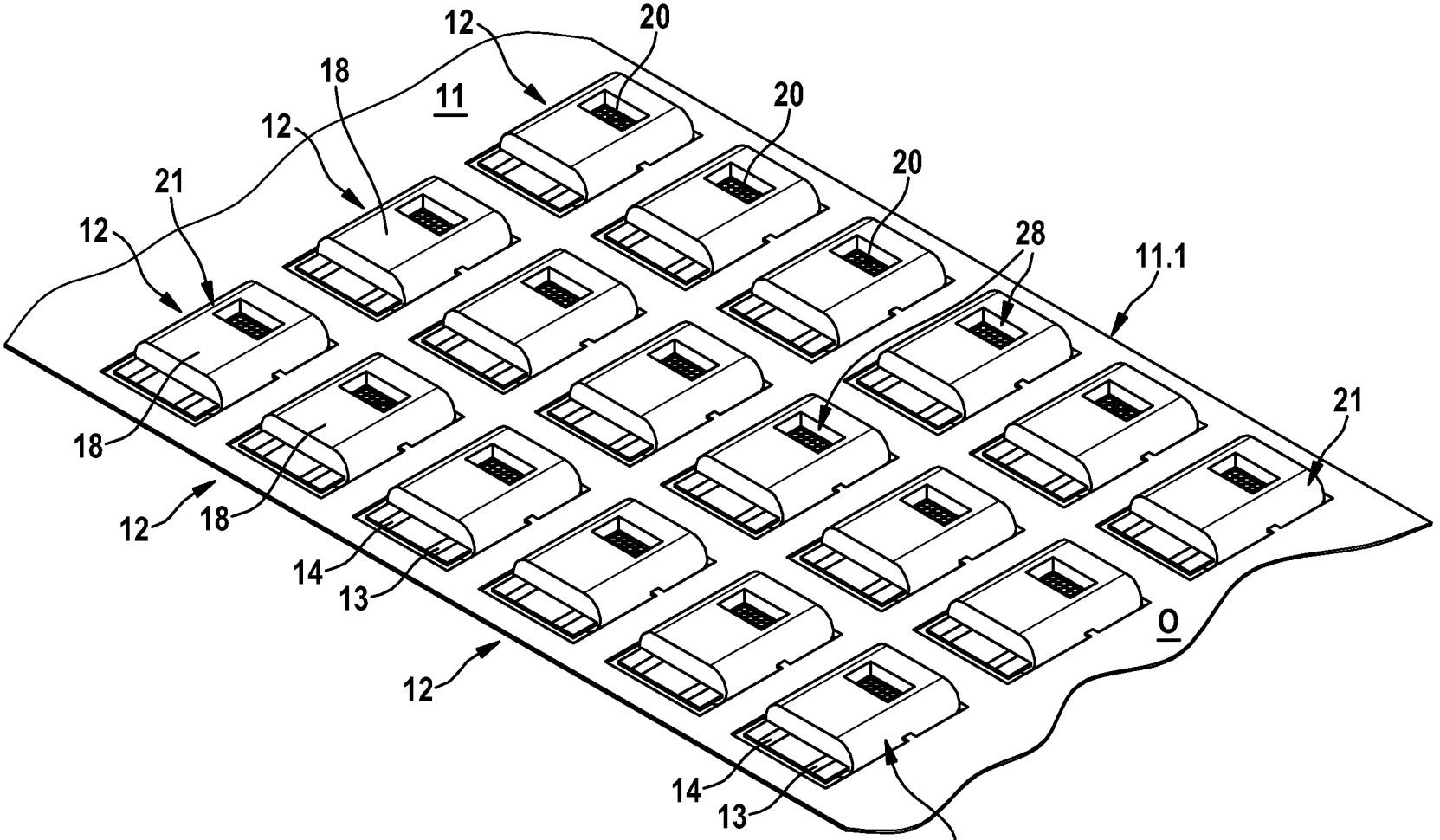
FIG. 6 is a perspective view showing an exemplary arrangement of a large number of vaporizer units on a circuit board portion prior to the step of isolation obliquely from above.

Steps a) and b) can be performed consecutively for the case that heating element 17 is not formed integrally with circuit board material 11 (see further below in this regard) so that at least a three-step method emerges in combination with step c). In the latter case, the fitting of each site 12 with at least one heating element 17 is performed, e.g., by means of an SMT pick-and-place machine, from upper side O of circuit board material 11 (see representation according to FIG. 3.3) which is also referred to as the contact side. The at least partial covering of each site 12 with sealing material 18 is performed at least from upper side O of circuit board material 11. The "Film-Assisted-Moulding" method technically known in principle is particularly preferably used for this purpose such that each heating element 17 is covered circumferentially at least in the edge region 17.1, wherein sealing material 18 preferably reaches as tight as possible to active, actual heating surface 20 (see representation according to FIG. 3.5) which remains free from sealing material 18 in order to ensure a liquid/vapour transport through the heating element. FIG. 6 shows by way of example an upper side O of a belt 11.1 composed of flexible circuit board material 11 with several sites 12 after step c). In the case of partial or complete covering/sheathing/overmoulding or the like of sites 12, initially film foils, at least one, preferably two, are placed into defined moulds, where they bear tightly against the inside of the moulds, e.g., by means of vacuum before continuous belt 11.1 is introduced and preferably silicons are supplied as sealing material 18 for the formation of sheathing 19. It is, however, also conceivable that a suitable plastic or polyimide is used. At least heating element 17 partially and parts of circuit board material 18 at each site 12 are covered or enclosed in a sealing manner with sheathing 19. The covering of each site 12 with sealing material 18 can, however, also be performed from lower side U of circuit board material 11 or from both sides, for example, in the event that heating element 17 is placed on the lower side.

The method steps described below represent preferred embodiments seen on their own and in combination with one another. It is expressly pointed out that further developments and method steps which are summarised in the claims and/or the description and/or the drawing or are described in a joint embodiment, can also functionally independently further develop the method and the components which arise from this.

Figure 5A:
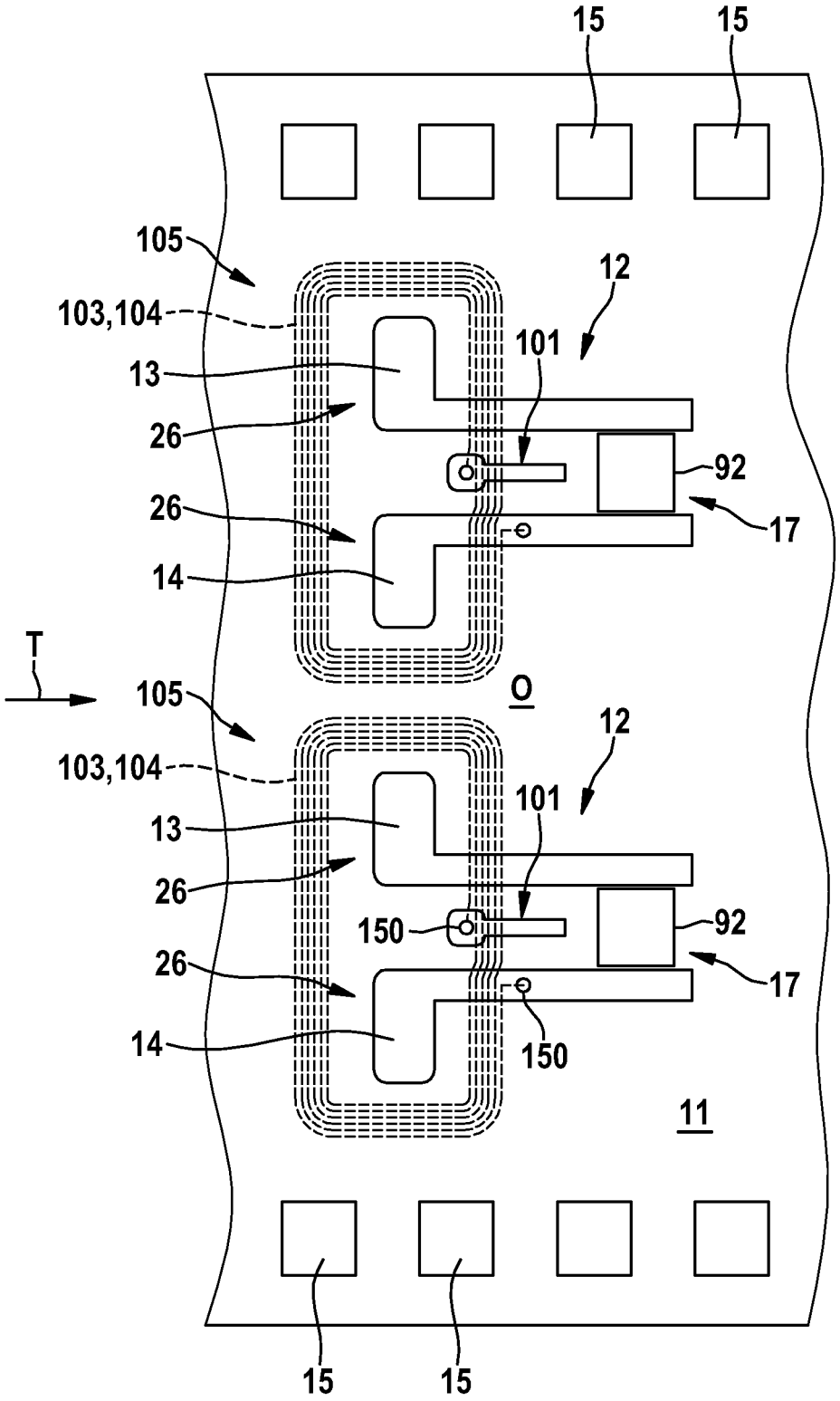
FIG. 5*a* is a schematic view showing an upper side of a portion of a further embodiment of the circuit board material with in each case two sites having a heating element and in each case two sites having an RFID antenna.

Preferably, in step a), flexible circuit board material 11 is provided, see, e.g., FIG. 5*a*, in the case of which at least one site 101 for an RFID chip 102 (see FIG. 1*aa*) is formed in the region of each site 12 for an individual vaporizer unit 10, and that flexible circuit board material 11 is pre-structured in terms of the position and/or course of predetermined conductor paths 103, 104 as an RFID antenna 105. In FIG. 5*a*, site 101 forms a connection site for a further electronic component, for example (RFID chip 102. FIG. 5*a* further indicates that an RFID antennae 105 is disposed or formed on the lower/rear side of circuit board material 11 with respective through-contacting 150 (see FIGS. 1*aa*, 1*bb* and 5*a*) on the surface.

Circuit board material 11 can be differently pre-structured in terms of additional site 101 for RFID chip 102 and its electric connection or wireless connection. Conductor paths 13, 14 for heating element 17 can form RFID antennae 105 as a coil. Optionally, however, separate conductor paths 103, 104 form the coil as an RFID antenna 105. Several conductor paths can also be pre-structured in order to form on one hand a receiving antenna (receiving coil) and on the other hand a transmission antenna (transmission coil). Communication between RFID antenna and RFID chip can be performed electrically or via electromagnetic coupling, just like the voltage supply of the RFID chip. The pre-structured RFID antennae can be arranged and formed preferably in parallel planes to one another and at a small distance. Flexible circuit board material 11 is particularly preferably optionally pre-structured at least with conductor paths and pre-punched areas predetermined in terms of position and/or course for each site 101 for electronic connection of at least RFID chip 102.

RFID chip 102 can be an integral component of pre-structured circuit board material 11. In the event that RFID chip 102 is a separate component, an RFID chip 102 is provided and placed at each site 101 in a step k), which can correspond to step h) described further below and which can be performed before, with or after step b). RFID chip 102 which is optionally connected or connectable electrically to conductor paths 103, 104 is preferably provided and placed, wherein RFID chip 102 is optionally connected or connectable at each site 101 to conductor paths which form RFID antenna 105, and indeed electrically or via electromagnetic coupling.

Moreover, the method steps described previously in conjunction with heating element 17 correspondingly apply for RFID chip 102 and RFID antenna 105. Site 101 for RFID chip 102 is optionally also covered with sealing material 18 while forming sealing surfaces in step c) additionally for partially covering each site 12 for heating element 17. In other words, RFID chip 102 is protected from the surroundings by sealing material 18.

As already indicated, the provision of flexible circuit board material 11 in step a) can optionally be carried out by rolling out circuit board material 11 stored or supplied on rolls or by supplying portions of circuit board material 11 stored in magazines or the like.

Figure 7:
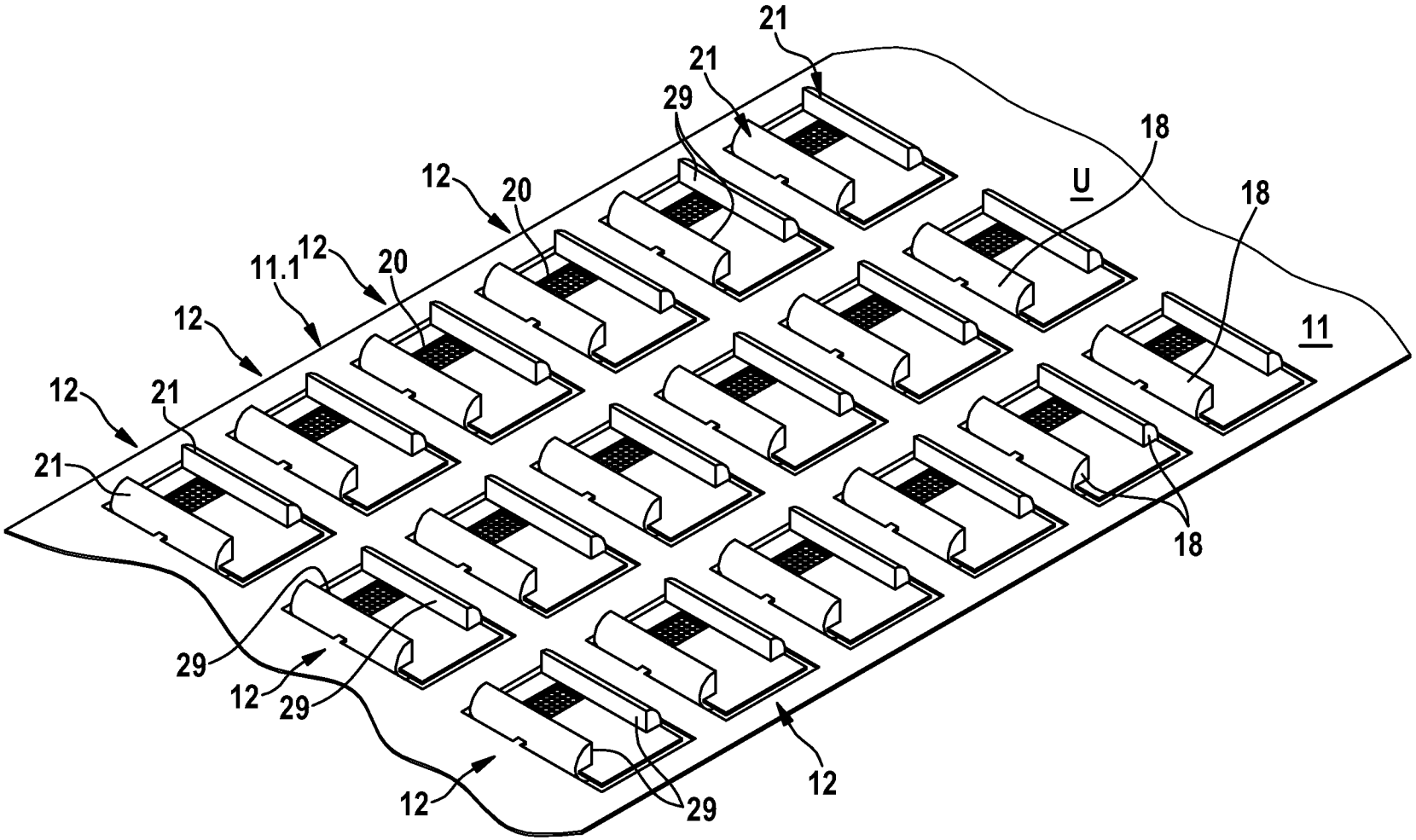
FIG. 7 is a perspective view showing the arrangement according to FIG. 6 obliquely from below.

Preferably, in step c) each site 12, 101 is at least partially enclosed with sealing material 18 in such a manner such that sealing surfaces 21 for an existing connection free of additional sealants to the components of inhaler 100 surrounding vaporizer unit 10 (see further below in the regard) are formed additionally both on upper side O and on a lower side U, opposite upper side O, of flexible circuit board material 11 on the outer surfaces of sheathing 19. In other words, the enclosing of each site 12, 101 is performed from both sides of continuous belt 11.1, e.g., by overmoulding from upper side O and lower side U or by overmoulding exclusively from upper side O, wherein sealing material 18 travels through pre-punched areas 24 at each site 12, 101 to lower side U. Sealing surfaces 21 are preferably partially or completely defined and formed to be reproducible. By way of example, FIG. 7 shows a lower side U of a continuous belt 11.1 composed of flexible circuit board material 11 with several sites 12 after step c). As shown in FIG. 3, pre-punched areas 24 furthermore serve to be able to separate each vaporizer unit 10 as easily as possible from circuit board material 11. With the exception of two connecting webs 70, pre-punched areas 24 are preferably formed circumferentially around each site 12, 101. Only one web 70 or more than two webs 70 can of course also be provided. Pre-punched areas 24 for later separating out can, however, also be entirely or partially dispensed with. In this case, only pre-punched areas 24 are provided if sealing material 18 is supposed to flow around the substrate.

In the case already indicated further above that heating element 17 is not an integral component of circuit board material 11, but rather circuit board material 11 is to be fitted separately with each heating element 17, step b) comprises: as step b1) the application of electric contacting material 25 at least on contact surfaces 26 of conductor paths 13, 14 (see representation according to FIG. 3.2) at each site 12 on upper side O of flexible circuit board material 11; as step b2) the placing of the at least one heating element 17 in the region of each site 12 such that a pre-punched area 16 which connects upper side O to lower side U of circuit board material 11 and which later forms the passage opening of vaporizer unit 10 is fully covered by the or each heating element 17 (see representation according to FIG. 3.3); and as step b3) the formation of an electric connection between heating element 17 and conductor paths 13, 14 at each site 12. After the provision of the continuous belt prefabricated with conductor paths 13, 14 and pre-punched areas 15, 16, 24 (see representation according to FIG. 3.1) at a first production station, e.g., sinter paste is applied onto contact surfaces 26 at a second production station. Each heating element 17 is subsequently received by a pick-and-place machine, positioned and placed on contact surfaces 26 coated with sinter paste so that pre-punched area 16, which forms the passage opening. is fully covered by heating element 17. By carrying out a sintering process, e.g. in a sintering press, a permanent electric connection is generated between heating element 17 and conductor paths 13, 14, as a result of which heating element 17 is additionally fixed on circuit board material 11. Very particularly preferably, each heating element 17 is connected by a direct contacting by means of silver sintering electrically to conductor paths 13, 14 of flexible circuit board material 11. Steps b1) and b2) can also be linked to one another in that, e.g., the fitting of heating element 17 is performed by a film provided with contacting material 25 or the like so that heating elements 17 quasi "bring along" contacting material 25 during pushing through and placing on contact surfaces 26. Alternatively, every other method described above is suitable for the production of an electric connection between conductor paths 13, 14 and heating element 17. Ultimately, heating element 17 can also be prefabricated with contacting material 25, for example, in that a silicon chip on a wafer is already laminated with contacting material 25.

In the event that RFID chip 102 is to be fitted separately, step k) comprises: as step k1) the application of electric contacting material 25 at least on contact surfaces of conductor paths at each site 101 on upper side O of flexible circuit board material 11; as step k2) the placing of the at least one RFID chip 102 in the region of each site 101; and as step k3) the formation of an electric connection between RFID chip 102 and conductor paths at each site 101. As already described further above, the electric contacting material can in step k1) also optionally be applied directly onto the contacts of the RFID chip, wherein the RFID chip prepared in such a manner is then placed onto site 101.

The method is described above for the case that heating element 17 is placed and connected on the upper side of circuit board material 11. A placing and a connection on the lower side is also optionally and correspondingly possible. It is also possible that heating element 17 is placed on the upper side, wherein the electric contacts, i.e. e.g. conductor paths 13, 14 are arranged on the lower side. Pre-punched areas 24 in the region of the electric contacts of heating element 17 connect the upper side and the lower side so that contacting material 25 is applied in the region of pre-punched areas 24 which after step b3) produces a connection between heating element 17 on the upper side and conductor paths 13, 14 on the lower side. The same applies to each RFID chip 102.

The below numbering of steps d) to h) and k) does not represent an obligatory sequence of the steps. On the contrary, steps d) to h) and k) can be performed quasi as desired in terms of their sequence. Step k) is particularly preferably carried out directly before or after step b).

After step c), continuous belt 11.1 can, for example, be rolled up again in order to be able to use a roll-to-roll process for the production of vaporizer units 10. This means that initially in step a) a roll with rolled-up flexible circuit board material 11 is provided. Subsequently, a number of vaporizer units 10 are mapped thereon in steps b) and c). Finally, flexible circuit board material 11 can be rolled up again in a step e) for further use, for example, for transport, for storage or the like. If portions of circuit board material 11 are processed, these can, e.g., in step e), be supplied back to a magazine or the like for further use.

When covering or enclosing sites 12 with sealing material 18, due to the process, what are known as sprue points are generated, i.e. material webs which arise during moulding, spraying or other processing of sealing material 18. Preferably, after step c) the sprue portions of sealing material 18 which arise during covering or enclosing of the sites with sealing material are removed in a step d). Removal can also be performed later, e.g., when separating out individual vaporizer units 10. Renewed rolling up can, as mentioned, be performed, e.g. after step c) and optionally subsequently after each further step. Rolling up can optionally even already be performed after step b). Circuit board material 11 provided with the plurality of completed, sealing vaporizer units 10 free from sprue portions can correspondingly preferably be rolled up for the first time or again in step e) onto a roll for further use. The same applies in the case of use of portions of circuit board material 11 in magazines or the like.

Produced, sealing vaporizer units 10, which are, i.e., provided with sealing surfaces 21 and which are sealing in combination or by mounting with other components of inhaler 100 without additional sealant, are isolated from flexible circuit board material 11 for further use in a step f). For the purpose of isolation, rolled-up circuit board material 11 provided with vaporizer units 10 can be rolled out again at a later point in time, for example, at a mounting site for vaporizer units 10. Isolation can be performed, e.g., by punching, cutting or the like. Isolation can also be performed directly after step d) in order to produce, e.g., trayware or bulkware.

In order to complete each vaporizer unit 10, in a step g) at least one wick element 27 (e.g., FIG. 8) is placed on upper side O of flexible circuit board material 11 on at least a part of free heating surfaces 20 of heating elements 17 at each site 12. Wick element 27 can be formed in one piece, e.g., as a block composed of ceramic or as a glass fibre or cotton wool pad or in a different manner and be placed, e.g., together with step b) or after step b) in any desired sequence of steps. Joint fitting in step b) is particularly preferred if wick element 27 and heating element 17 form a composite. Wick element 27 can, however, also be placed after step c) or after step d) or also after step f). In another variant in which wick element 27 is, e.g., a granular wick element 27, the granulate can be poured, e.g., after isolation, into a recess 28 (e.g. FIG. 6) formed in sheathing 19, in which recess 28 heating surface 20 of heating element 17 is exposed. Wick element 27 can then, e.g., be fixed by gluing or other connecting techniques by a combination/mounting with a further component of inhaler 100 (see in this regard further below). Wick element 27 can, in other embodiments, also be placed and/or fixed on a side opposite heating element 17. Neither heating element 17 nor wick element 27 necessarily have to be arranged on one side and in particular also not necessarily on the upper side.

Optionally, in a step h), which can correspond to step k), preferably together with step b2) or k2), at least one additional electronic component can be placed in the region of each site 12. Step h) can, however, also be carried out before or after step b2) or k2). Prior to step h), preferably together with step b1 and k1), contacting material 25 is applied on contact surfaces 26 of conductor paths 13, 14 at each site 12 on upper side O and/or lower side U of flexible circuit board material 11, and after step h), preferably together with step b3) or k3), an electric connection is formed between the or each additional electronic component and conductor paths 13, 14 at each site 12. This can involve conductor paths 13, 14 of heating element 17. The electronic components can, however, also be contacted electrically at/on separate conductor paths. The electronic components can be placed on the side of heating element 17 and/or on the opposite side. The or each additional electronic component, e.g., ID chips, sensors or other electronic components, can be partially or completely covered or enclosed by sealing material 18. This can be carried out, e.g., in step c). It is also possible that the electronic components are entirely or partially sheathed in a separate step by the same sealing material 18 or a different material.

Each heating element 17 and/or each RFID chip 102 and/or each additional electronic component, in particular each ID chip, is connected electrically to conductor paths 13, 14, or other contacting surfaces of circuit board material 11 as a result of the use of one or more methods from the list (not exhaustive): direct contacting by means of silver sintering, eutectic bonding, conductive gluing, anisotropically conductive gluing, KlettWelding, KlettSintering, soldering, welding. In particular, the RFID chips and other electronic components can optionally also be connected by means of wire bonding to conductor paths 13, 14 of circuit board material 11. For this purpose, the electronic components (RFID chip etc.) are fixed with a non-conductive adhesive on of circuit board material 11 and then connected.

In a further development of the method, e.g., in step c), at least preferably web-like portions 29 (see, e.g., FIG. 7) of an air flow channel 30 (see, e.g., FIGS. 2 and 9) are formed during covering or enclosing of each site 12 from and/or with sealing material 18 on lower side U of circuit board material 11 at each site 12. In this case, portions 29 form a part of the wall of air flow channel 30 to be formed. The shaping of parts of air flow channel 30 or of a completely formed air flow channel 30 can also be carried out in a separate step with a material which deviates from sealing material 18. In a further embodiment, at each site 12 a tubular, prefabricated portion 31 (also referred to as tube portion 31) is placed as part of an air flow channel 30 on lower side U of circuit board material 11 and enclosed and thus fixed by means of additional sealing material 32 (see FIGS. 2 and 10). As mentioned, sealing and/or air flow channel portions can be formed prior to/during/after step c) on lower side U of flexible circuit board material 11. The sealing and/or flow function of vaporizer unit 10 is described in greater detail further below in conjunction with the mounting.

At least steps a) to c) are carried out consecutively in each case at a separate or the same production station of a production line 33 in such a manner that, in the case of each step at each production station 34 to 39, a plurality of sites 12, 101 are or can be simultaneously processed. There is, for example, the option that sintering for producing the electric connection and the enclosing with sealing material 18 are performed in/at a production station. This simultaneously means within the meaning of the invention that the same steps are carried out at several sites 12, 101 or that several/different steps are carried out at several sites 12, 101. The entire production process of vaporizer units 10 is, however, particularly preferably carried out in a joint production line 33 with several production stations 34 to 39. An exemplary production line 33 is indicated schematically in FIG. 3. At a production station 34 (representation according to FIG. 3.1) in a step a) the or each roll with rolled-up circuit board materials 11 is stored and provided for unwinding or possibly also for active rolling out. At a production station 35, for example, with a screen-printing machine, in a step b1) or k1) electric contacting material 25 is applied (representation according to FIG. 3.2). At a production station 36, for example, with an SMT pick-and-place machine, in a step b2) or k2) the or each heating element 17 or the or each RFID chip 102 is received and placed (representation according to FIG. 3.3). At a production station 37, for example, with a sintering press, in a step b3) or k3) the direct electric contacting is formed (representation according to FIG. 3.4). At a production station 38, for example, with a Film-Assisted-Moulding machine, in a step c) each site 12, 101 is covered or enclosed at least partially with sealing material 18 (representation according to FIG. 3.5). At a production station 39, for example, with a punching machine, in a step f) vaporizer units 10 are isolated in that they are separated/detached from circuit board material 11 (representation according to FIG. 3.6). In order to produce vaporizer units 10, flexible, pre-structured circuit board material 11, which is preferably composed of polyimide in one example, is unwound as a continuous strand from a supply roll and transported continuously or intermittently through production line 33 comprising the several production stations 34 to 39. In other examples, portions of circuit board material 11 can be transported, e.g., in magazines through the production line. Alternatively, however, all of the contacting methods described further above can be used during the production process. Two or more than two production lines 33 can also be provided.

Process sequences/step sequences which are preferred purely by way of example are described below. Circuit board material 11 is provided on rolls. Circuit board material 11 is unwound on a first production line 33. By means of stencil printing, circuit board material 11 is printed with a sinter paste at the positions at which heating elements 17 are later placed. After inspecting the print image, heating elements 17 are placed by means of an SMT placer, i.e., a pick-and-place apparatus. Circuit board material 11 is subsequently dried with a hot plate from below. Sintering is performed with hot stamps from above on the same plate. Finally, fitted circuit board material 11 is rolled up again.

At a further production line 33 with a corresponding structure or the same production line 33, where applicable, with adapted programmes for printing and placing at least one RFID chip, the above sequence of steps can be repeated so that circuit board material 11 fitted with heating elements 17 and RFID chips 102 is then provided in a rolled-out state.

Circuit board material 11 prepared and fitted in such a manner can then be further processed on a further production line which is preferably separate as a result of lower capacities, wherein the or each additional production line is formed as a FAM line (Film-Assisted-Molding). Prefabricated circuit board material 11 can be rolled out in the FAM line or FAM apparatus. After rolling out, connection points/sites including heating elements 17 and RFID chips 102 are sheathed with silicon. After the separation of the sprue residues, circuit board material 11 is rolled up again.

This process sequence only represents a selected example which can be varied almost as desired.

Figure 4:
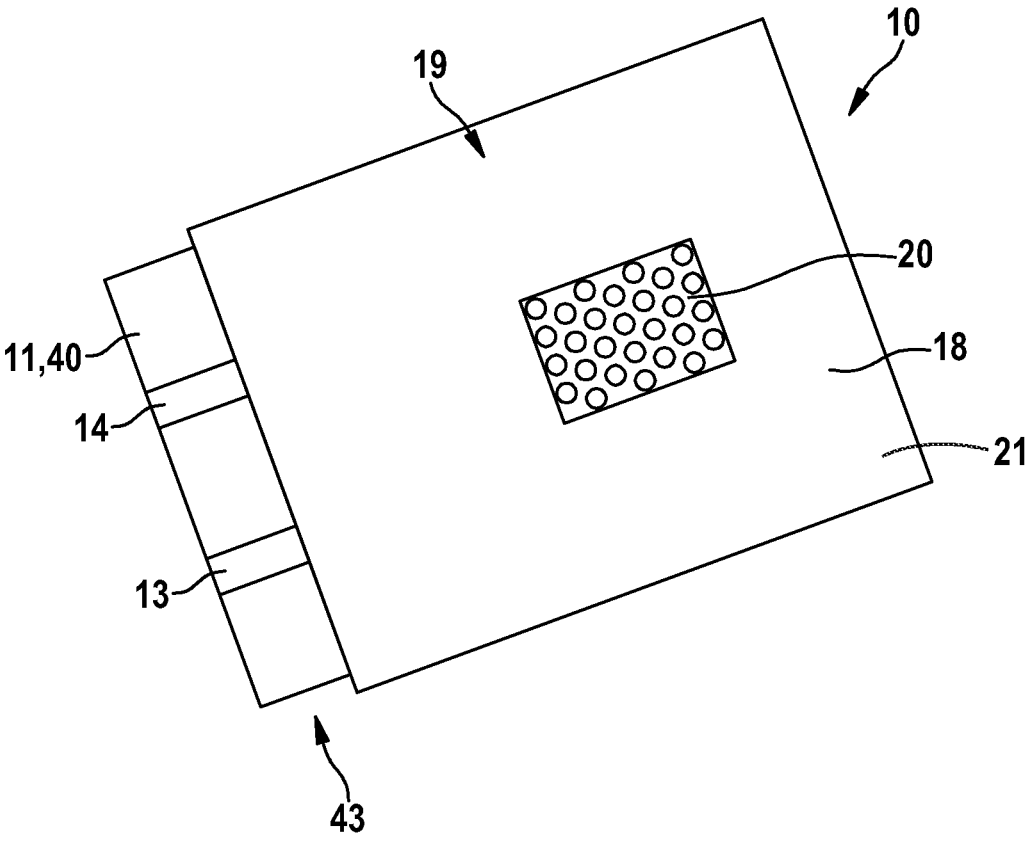
FIG. 4 is a schematic view of a vaporizer unit isolated/separated from the belt.

Isolated vaporizer units 10 are produced (see, e.g., FIGS. 4 and 1*aa*) with the method. Vaporizer units 10 according to the invention as a component part of inhalers 100 are characterised in that they have the following components: a circuit board portion 40 composed of flexible circuit board material 11, wherein circuit board portion 40 comprises at least two conductor paths 13, 14 and a passage opening 41 which connects an upper side O of circuit board portion 40 to a lower side U of circuit board portion 40, heating element 17, which covers passage opening 41 fully from upper side O and is in electric contact with conductor paths 13, 14, as well as a sheathing 19 which is composed of sealing material 18, which at least partially covers circuit board portion 40 and heating element 17 while keeping open a heating surface 20 and which is provided towards the outside with sealing surfaces 21. A schematic representation can be inferred from FIG. 4. Circuit board portion 40 can comprise, however, instead of passage opening 41, an integral heating element 17 which has a region 92 of a micro-structuring and is connected electrically to conductor paths 13, 14 (see FIG. 5). For example, a heating element 17 which fully covers passage opening 41 from lower side U and is in electric contact with conductor paths 13, 14 also has the same technical effect.

FIGS. 1*a*), 1*b*) and 2 show enlarged representations of preferred embodiments of vaporizer units 10 in section, in the case of which a wick element 27 is placed on heating surface 20. A basic variant without air flow channel 30 is represented in FIG. 1. The passage of generated vapour in the direction of flow channel 30 is ensured via passage opening 41 and liquid-permeable heating element 17. A prefabricated tube portion 31 for the formation of air flow channel 30 with vaporizer unit 10 is formed on lower side U of circuit board portion 40 in FIG. 2, wherein tube portion 31 is connected by means of additional sealing material 32 to vaporizer unit 10. An opening 42 in sealing material 32 is provided above wick element 27 so that wick element 27 is exposed in the direction of a supply tank in order to produce a fluid connection to the supply tank. Tube portion 31 has in the region of heating element 17 and passage opening 41 an opening 55 to enable an escape of the vaporised liquid into air flow channel 30. Alternatively, air flow channel 30 can also be formed partially or entirely from sealing material 18. In the case of a partial formation, vaporizer unit 10 can have, e.g., web-like portions 29 shown in FIG. 7. Said web-like portions 29 form a partial wall of an air flow channel 30 which is not entirely closed in the circumferential direction, which interacts with walls or surfaces or the like of other components (such as, e.g., the inner geometry of the adapter plug, a vaporizer cartridge or the like) and thus forms an air flow channel 30 which is completely closed in the circumferential direction.

In all of the embodiments described here of a vaporizer unit 10, electric contacting, i.e., electric connection, of heating element 17 to conductor paths 13, 14 can be performed directly or indirectly. In the case of direct contacting, at least a part of conductor paths 13, 14 which should be or is contacted electrically to heating element 17 is arranged on the same side of circuit board portion 40 as heating element 17. Electric contacting is performed in this case via the methods described here in conjunction with the invention. In the case of indirect contacting, the part of conductor paths 13, 14 which should be or is contacted electrically to heating element 17 is arranged on the side of circuit board portion 40 which is opposite the side on which heating element 17 is or is supposed to be arranged. In this case, an electric contacting, i.e., connection of the electric contacts, of heating element 17 to conductor paths 13, 14 is performed through circuit board portion 40. These contacts are correspondingly not shown or not visible in the represented exemplary embodiment.

In order to produce the contacting, one or more openings can be provided in circuit board portion 40, in which one or more openings electrically conductive material is arranged which produces the electric connection between heating element 17 and conductor paths 13, 14. Alternatively, electric connections which are continuous from one to the other side, i.e., from upper side O to lower side U of circuit board material 11, can already be provided during the prefabrication of circuit board material 11 so that contacts points are present on the side opposite conductor paths 13, 14, to which contact points heating element 17 can be electrically connected. In this case too, electric contacting is performed via the methods described here in conjunction with the invention.

In one preferred embodiment, circuit board portion 40 comprises at least one RFID chip 102 and at least one RFID antenna 105. RFID antenna 105 can be formed by windings of heating element 17. The or each RFID antenna 105 is preferably formed by separate conductor paths 103, 104. RFID antenna 105 and heating element 17 can be arranged or formed on the same side of circuit board portion 40 or on opposite sides. RFID antenna 105 can preferably be arranged on circuit board portion 40 in such a manner that it encloses heating element 17 in the plane of circuit board portion 40 in an inner region enclosed by it. The location and/or position of RFID chip 102, the number of RFID chips 102, as well as the location and/or position and/or alignment of the or each RFID antenna 105 in relation to heating element 17 can vary. The transmission of data is optionally performed wirelessly. To this end, e.g., RFID chip 102 can contain an antenna.

Circuit board portion 40 of vaporizer unit 10 is preferably formed from polyimide, wherein other flexible substrate materials can also be used. A doped silicon chip is particularly preferably connected as heating element 17 by direct contacting by means of silver sintering electrically to conductor paths 13, 14. Other components, in particular MEMS components (Micro-electro-mechanical components) which are composed substantially from silicon or which have silicon or p- or n-doped silicon and which are liquid-permeable, can also be used as heating element 17. In particular, what are known as film vaporizers/film heaters can also be used as heating element 17. Circuit board portion 40 as well as a silicon chip are at least partially enclosed by silicon or polyimide so that on one hand the silicon chip is mechanically retained and on the other hand sealing surfaces 21 preferably defined towards the outside are formed. Instead of silicones, other materials which can be processed in particular using the Film-Assisted-Moulding method and which act in a sealing manner in the processed state can also be used. Examples of further active ingredients which can be processed using the Film-Assisted-Moulding method are polyimide or plastics.

Figure 1B:
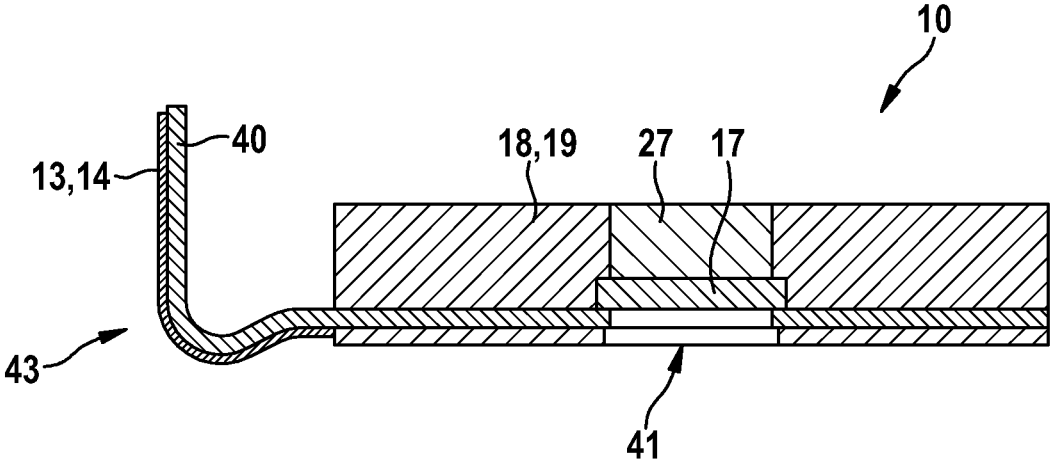
Figure 1A:
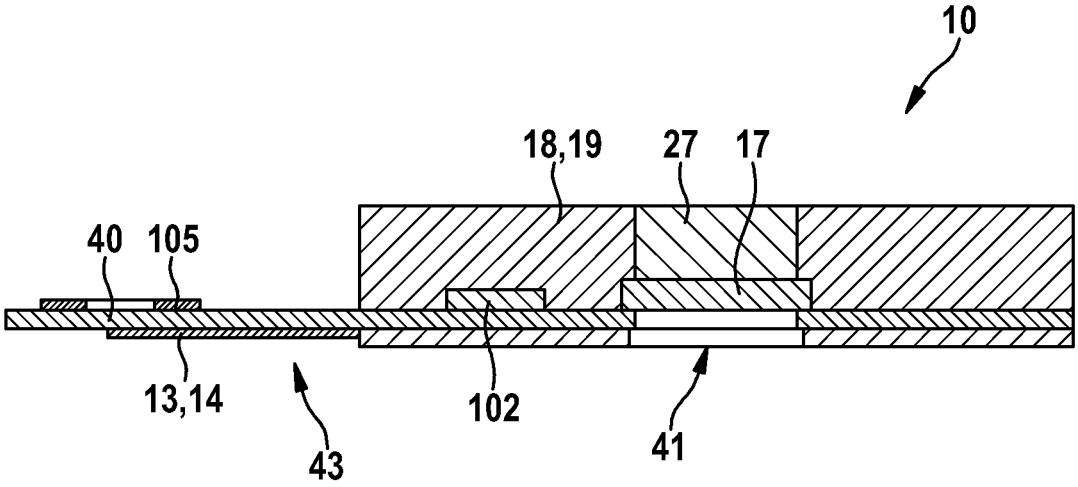
Figure 1B:
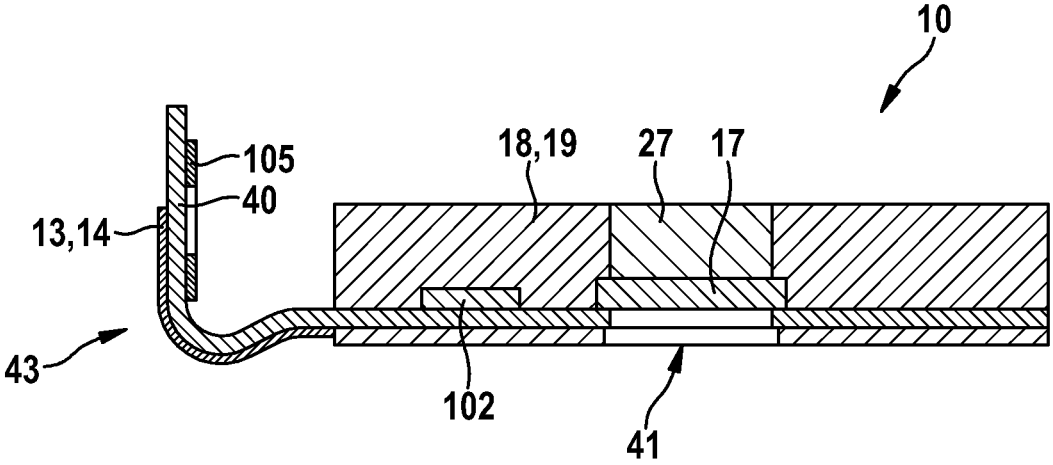

In one preferred further development, a portion of conductor paths 13, 14 embedded in flexible circuit board material 11 projects in a bendable manner out of sheathing 19 formed by sealing material 18 for the formation of flex contacting 43. A space-saving contacting possibility of conductor paths 13, 14 can be generated by bending the projecting portion, for example, by 90°. FIG. 1*a*) represents the embodiment in the case of which flex contacting 43 is still not bent. FIG. 1*b*) represents flex contacting 43 in the bent state. As is furthermore apparent from the embodiments of preferred vaporizer units 10 in particular in FIGS. 1 and 2 as well as 8 to 11, heating surface 20 is covered on upper side O at least partially, preferably, however, entirely by a wick element 27. As already mentioned, wick element 27 can have different designs and be composed of different materials. Wick element 27 can optionally also be arranged on the lower side in so far as during mounting it is ensured that the path defined by wick element 27—heating element 17—air flow channel 30 is adhered to in the case of a fluid connection.

Vaporizer unit 10 is particularly preferably produced with a method described herein. The or each vaporizer unit 10 can be stored on a roll or a magazine or be used, stored and employed as an individual part, exchange part, replacement part or the like. Vaporizer unit 10 is preferably, however, a constituent part of a vaporizer assembly 44 which itself is a component part of an inhaler 100. Vaporizer assembly 44 comprises a vaporizer unit 10, preferably according to one or more of claims 24 to 30, as well as an adapter plug 45, into which vaporizer unit 10 can be plugged and is also plugged in the functional state, i.e., in a mounted state, wherein vaporizer unit 10 or its sheathing 19 bears at least partially with an outer surface of sheathing 19, i.e., sealing surfaces 21, at least partially in a sealing manner against an inner geometry of adapter plug 45. A sealing unit, in the case of which there is a fluid connection only via the path opening 47 in adapter plug 45—wick element 27—heating element 17—passage opening 41—opening 48 is already produced by the mounting which includes a simple pushing in of vaporizer unit 10 into adapter plug 45. In other words, a liquid in supply tank 62 of a vaporizer cartridge 59 can only travel via the above-mentioned path into the portion of air flow channel 50 and further into air flow channel 30 (after previous vaporisation at or in heating element 17).

Figure 8:
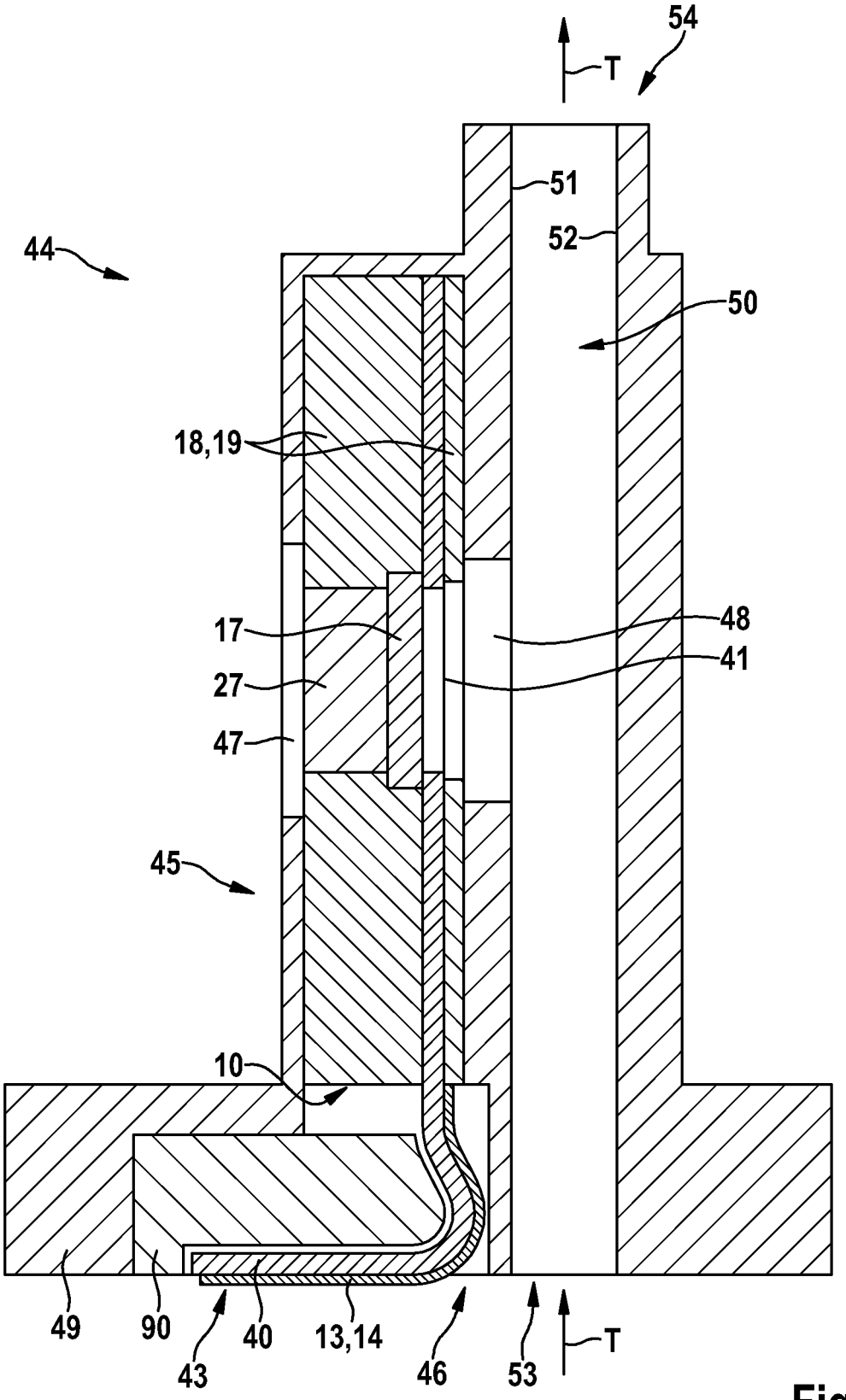
FIG. 8 is a schematic view showing a preferred embodiment of a vaporizer assembly according to the invention.
Figure 8A:
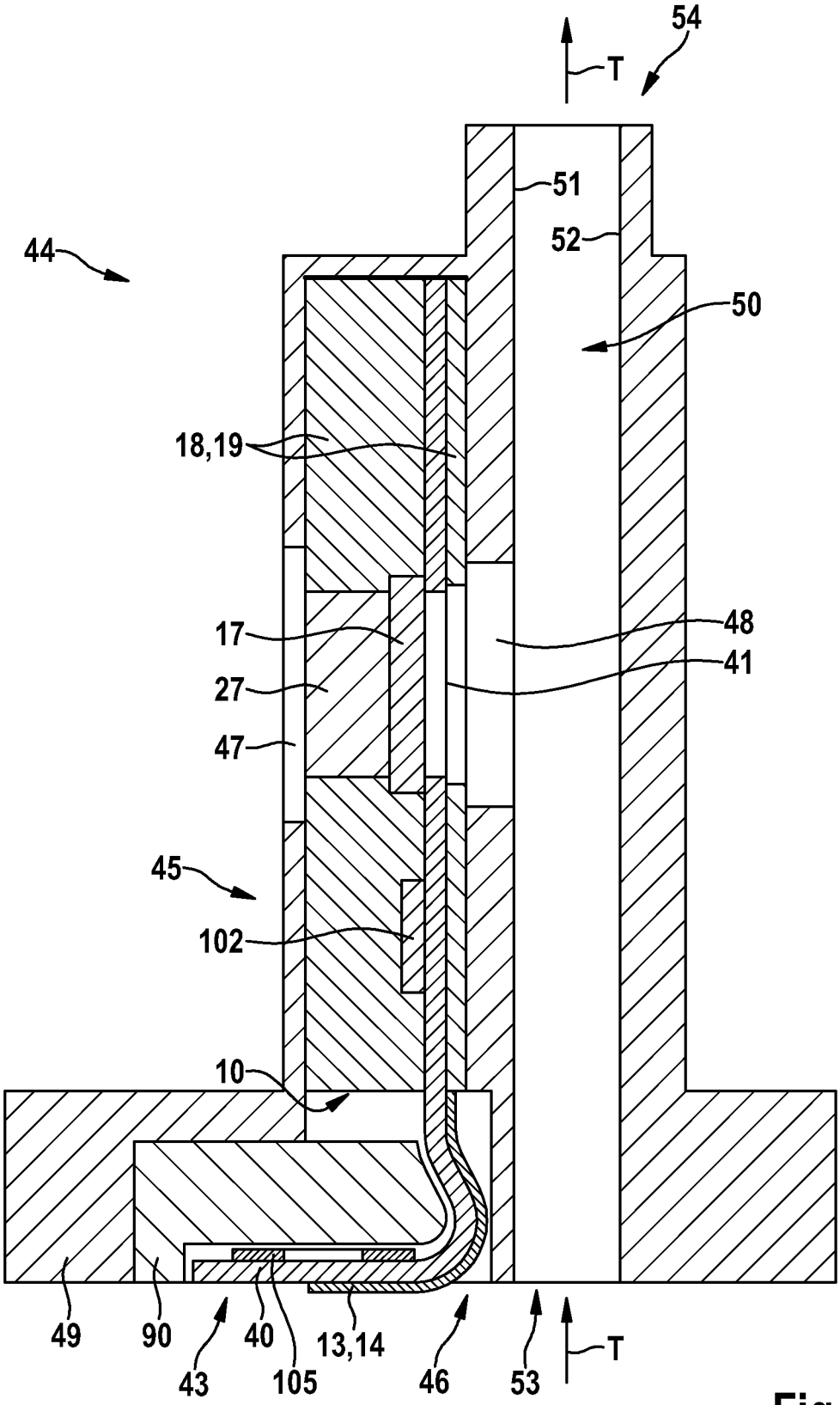
FIG. 8*a* is a schematic view showing a further preferred embodiment of a vaporizer assembly according to the invention.

A preferred embodiment of a vaporizer assembly 44 is represented in FIG. 8. In this embodiment, vaporizer unit 10 is plugged into a receiver 46, pocket or the like of adapter plug 45 (e.g., FIGS. 8-9). Receiver 46 has an opening 47 for producing a fluid connection to a supply tank. Receiver 46 furthermore has an opening 48 in the direction of an air flow channel 30. Vaporizer unit 10 with its wick element 27 and its heating element 17 is placed between these openings 47, 48 so that liquid coming out of a supply tank can necessarily flow through vaporizer unit 10 in the direction of air flow channel 30 and can be vaporised by the vaporizer unit 10 in the direction of air flow channel 30. A plug insert 90 can optionally also be provided as a component part of vaporizer assembly 44 which is formed and configured for fixing/holding flex contacting 43 in the bent position. An embodiment is represented in FIG. 8*a* in which an RFID chip 102 is provided in addition to heating element 17. In addition to RFID chip 102 or as an alternative to this, at least a further ID chip or another electronic component can additionally be provided.

Vaporizer unit 10 can, however, also be connected in another manner in a positive and/or non-positive sealing manner to adapter plug 45. Sealing material 18 of sheathing 19 of a vaporizer unit 10 from FIG. 7 seals off with sealing surfaces 21 vaporizer unit 10 with respect to adapter plug 45 in FIG. 8 so that the running out of liquid between vaporizer unit 10 and adapter plug 45 is actively prevented without additional sealant. Adapter plug 45 optionally preferably has a flange-like cover portion 49 which is formed and configured, e.g. as a stop and/or as a cover for a supply tank.

Figure 9:
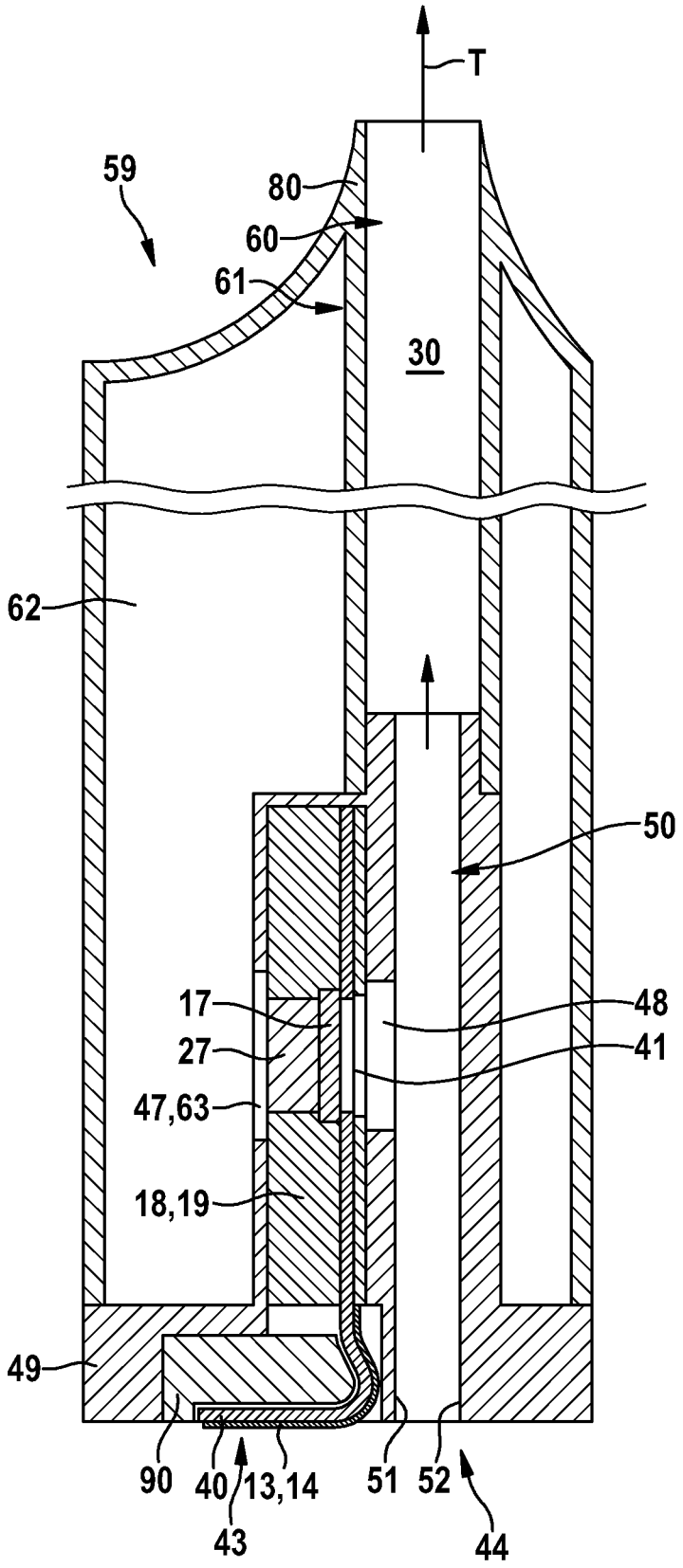
FIG. 9 is a schematic view showing a preferred embodiment of a vaporizer cartridge according to the invention.

Vaporizer assembly 44 comprises at least one portion 50 of an air flow channel 30 which is formed by vaporizer unit 10 and/or adapter plug 45. In FIGS. 8 and 9, portion 50 is formed by adapter plug 45 in that air flow channel 30 is delimited and formed by a wall 51 of receiver 46 and a wall 52 of portion 50. Portion 50 can, however, also be formed partially or completely by vaporizer unit 10. As already described further above, vaporizer unit 10 can as shown in FIG. 7 have on its lower side web-like portions 29 composed of sealing material 28. These web-like portions 29 form solely in a type of "open variant" a channel portion which is only partially closed in the circumference and only in the mounted state with adapter plug 45 together with wall 52 a circumferentially closed air flow channel 30 which is, however, open towards both front sides 53, 54 and is continuous. In other embodiments, such as, e.g. FIG. 2, vaporizer unit 10 makes available in a type of "closed variant" solely a tube portion 31 for the formation of a part of air flow channel 30. As already stated further above, tube portion 31 with second material 32, preferably a sealing material, can be fixed on vaporizer unit 10. Tube portion 31 can optionally be connected fixedly and permanently to vaporizer unit 10, e.g., by gluing or the like. Wall 52 then only serves as a sealing surface to vaporizer unit 10. Tube portions 31 as a prefabricated air flow channel element can be formed from sheet metal, ceramic, silicon, polyimide, plastic or other materials, preferably from a continuous strand profile. The cross-sectional form can vary, wherein a round cross-section is preferred. This can, however, e.g., also be semi-circular, square or rectangular. Tube portion 31 can, in particular for the case that it is manufactured from sheet metal, have in its shaping, e.g., in the form of beads or the like, contour changes in the cross-section in order to influence air guidance in a controlled manner in air flow channel 30.

Said tube portion 31 and/or portion 50 of air flow channel 30 can be coupled to further portions of air flow channel 30 of inhaler 100 for the formation of a continuous vent in inhaler 100 (see further below in this regard). In the event that tube portion 31 with second sealing material 32 is fixed on vaporizer unit 10, e.g., two circumferential seal contours 56, 57—similar to an O-ring—can be formed from second sealing material 32 in such a manner that vaporizer unit 10 with tube portion 31 is inserted in a directly sealing manner into a portion 58 of air flow channel 30 of a vaporizer cartridge 59 for the formation of a vent 60, wherein the internal diameter of portion 58 is at least partially or in portions larger than the external diameter of vaporizer unit 10 including linked tube portion 31 (see in particular FIG. 10). Mounted vaporizer assembly 44 with vaporizer unit 10 or vaporizer unit 10 separates by means of seal contours 56, 57 the aerosol-generating portion (supply tank—upper side of the vaporizer unit) from the aerosol-conducting portion (lower side vaporizer unit—air flow channel). It is, however, also conceivable that the inner diameter of portion 58 is at least partially or in portions smaller than the outer diameter of vaporizer unit 10 including linked tube portion 31.

Figure 10:
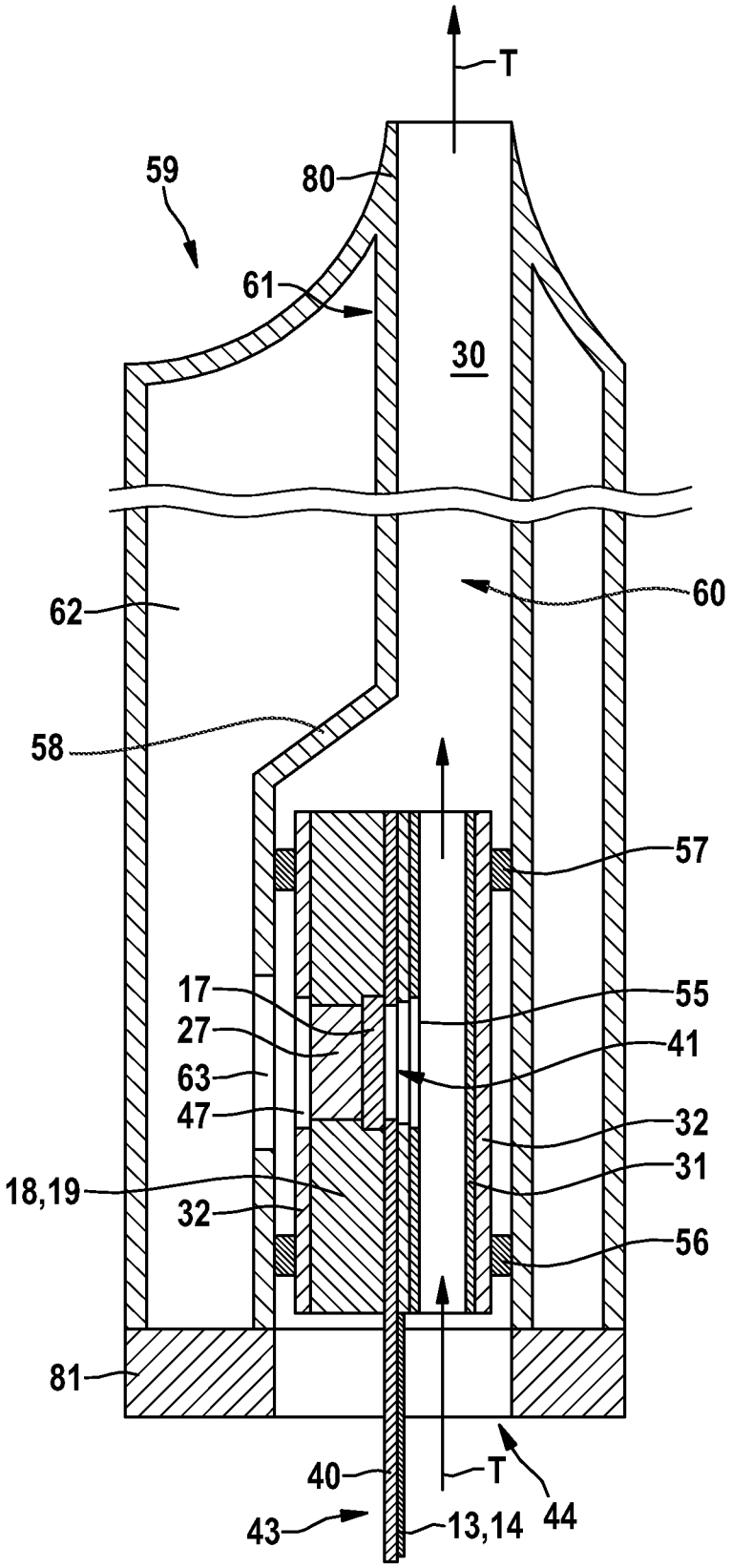
FIG. 10 is a schematic view showing a further embodiment of a vaporizer cartridge according to the invention.

Vaporizer assembly 44 or vaporizer unit 10 is correspondingly preferably a component of a vaporizer cartridge 59 (see in particular FIGS. 9 and 10) as a component of an inhaler 100. Vaporizer cartridge 59 comprises a hollow body 61 with at least one portion 58 of an air flow channel 30, a supply tank 62 for storing liquid, as well as a vaporizer assembly 44, wherein vaporizer assembly 44 is connected to hollow body 61 and supply tank 62 in a sealing manner such that portion 50 or tube portion 31 of air flow channel 30 of vaporizer assembly 44 and portion 58 of air flow channel 30 of hollow body 61 form a common air flow channel 30 or vent 60 which is liquid-impermeable towards the supply tank and supply tank 62 has at least one access opening 63 (e.g., in the form of opening 47 in FIG. 9 or in the form of opening 63 in FIG. 10) to air flow channel 30 in the regions of which vaporizer unit 10 is placed. The connection between portion 50 and portion 58 for the formation of vent 60 in FIG. 9 can be performed, e.g., by means of an interference fit. It is, however, also conceivable that a sealing element is arranged in the connection region between portion 50 and portion 58 which is configured to provide a liquid-impermeable transition between portion 50 and portion 58. Such an element could be formed, for example, from a silicon, polyimide, a rubber or another suitable elastic and sealing material. Such an element could be present, for example, in the form of a sealing ring or a sealing sleeve, a sealing sheath or a transition piece. The transition piece could be configured in the form of a cylinder in such a manner and engage in the region of a first end side of the cylinder with portion 50 in a sealing manner and engage in the region of a second end side of the cylinder with portion 58 in a sealing manner. In FIG. 10, portion 58 is formed to be convergent in the direction of mouth piece 80 in order to create an air flow channel 30/vent 60 which is where possible transition-free.

Figure 2:
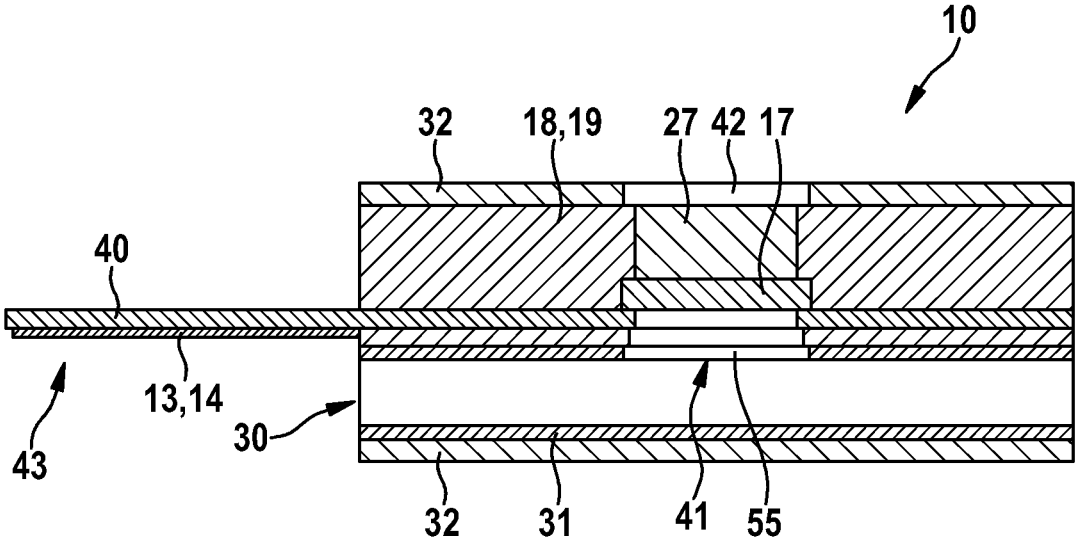
FIG. 2 is a schematic view of a further embodiment of a vaporizer unit according to the invention.

In the case of the embodiment according to FIG. 9, cover portion 49 of vaporizer assembly 44 closes off supply tank 62 in a liquid-impervious manner. As a result of this, a vaporizer cartridge 44 which is sealed off from the surroundings of the liquid outlet is formed which on one hand make available a continuous air flow channel 30 for an air flow to which aerosols are added, wherein air flow channel 30 is sealed to prevent the undesired penetration of liquid out of supply tank 62, and which on the other hand produces a fluid connection between supply tank 62 and air flow channel 30 in such a manner that liquid travels or can be transported out of supply tank 62 into the region of vaporizer unit 10 and the vapour generated in or at vaporizer unit 10 from the liquid can be discharged to air flow channel 30. The corresponding functionalities are also ensured in the case of the embodiment according to FIG. 10. Supply tank 62 is nevertheless sealed off by a separate cover 81. Vaporizer cartridge 59 can furthermore comprise a mount piece 80. It is, however, also conceivable that vaporizer cartridge 59 shown in FIG. 10 has an adapter plug 45 as shown in FIGS. 8 and 9 and vaporizer assembly 44 from FIGS. 2 and 10 is mounted in adapter plug 45. It is also conceivable that vaporizer cartridge 59 shown in FIG. 9 has a structure as in FIG. 10 with a separate cover 81. In both above-mentioned cases, that stated above in relation to FIGS. 9 and 10 applies in an analogous and directly transferrable manner.

Figure 11:
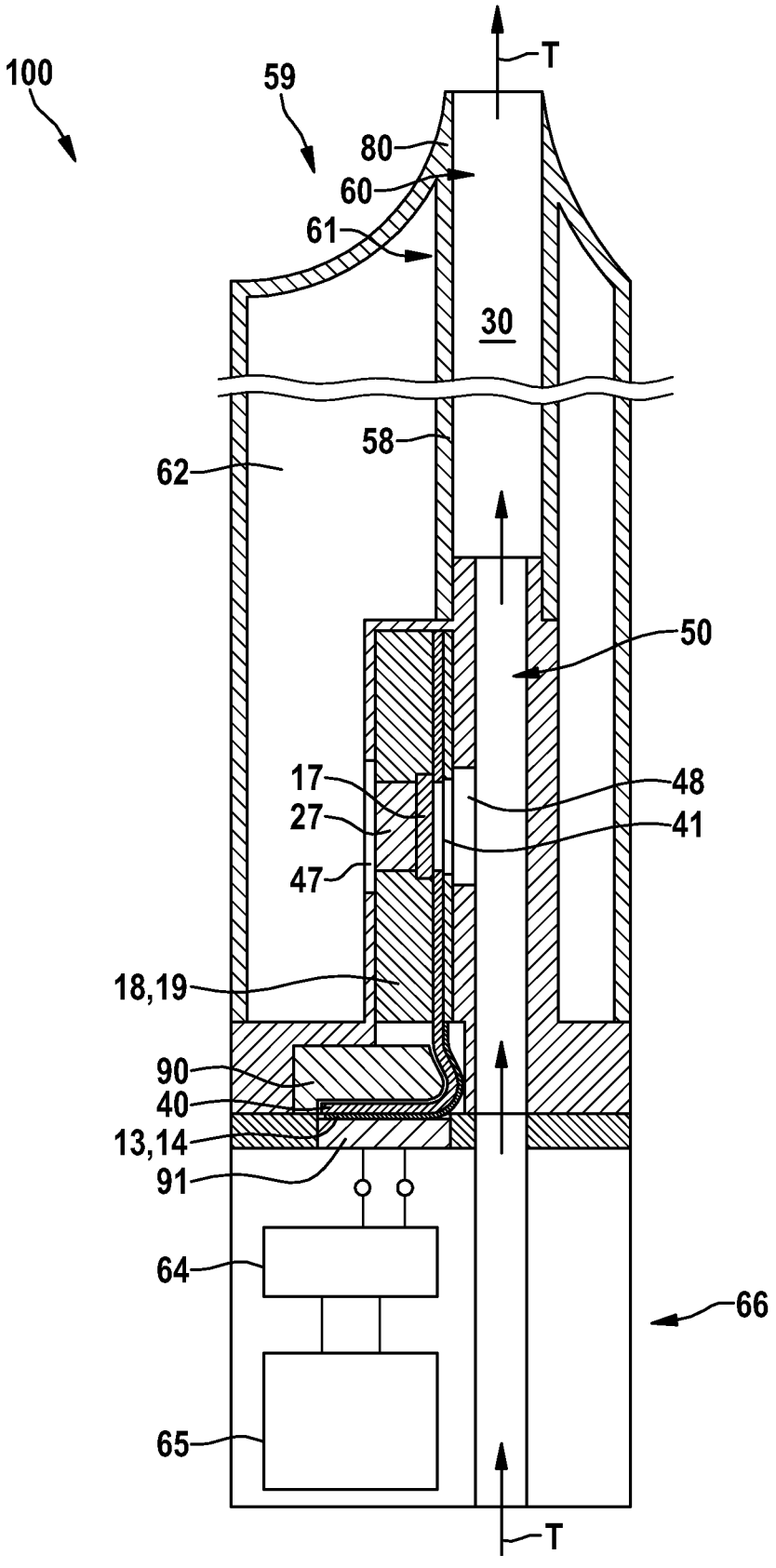
FIG. 11 is a schematic view showing a preferred embodiment of an inhaler according to the invention.

The invention furthermore relates to an inhaler 100, formed and configured for inhaling vapour/aerosol enriched with active ingredients and/or flavourings, which comprises at least one electronic control unit 64 and cartridge carriers 66 comprising an energy source 65 as well as a vaporizer cartridge 44, such as shown in FIG. 11. Inhaler 100 is represented as an E-cigarette. Inhaler 100 can, however, be used without any constructive adjustment only by selecting the substances to be inhaled in the medical and/or therapeutic sector. Cartridge carrier 66 can optionally comprise a mating contact 91 which is connected on one side to control unit 64 and electric energy source 65 and on the other side is in contact with conductor paths 13, 14. Mating contact 91 can, however, also be formed separately, e.g., as a plug-in part.

Vaporizer unit 10 or vaporizer assembly 44 according to the invention can, however, also be a component of an inhaler 100 in the case of which vaporizer unit 10 or vaporizer assembly 44 is arranged outside vaporizer cartridge 59 so that vaporizer assembly 44 is a fixed component of cartridge carrier 66, and correspondingly forms a multi-use item. Cartridge carrier 66, vaporizer assembly 44 and a vaporizer cartridge 59 only comprising hollow body 61 and/or supply tank 62 are optionally connected exchangeably with one another at different intervals.

Those of skill in the art will recognize that the embodiments discussed and illustrated herein may be altered in various ways without departing from the scope or teaching of the present invention. It is the following claims, including all equivalents, which define the scope of the invention.

What is claimed is:

1. A method for producing vaporizer units as a component of inhalers, comprising:

a) providing a flexible circuit board material with a plurality of sites for individual vaporizer units, the flexible circuit board material having an upper side and a lower side, the circuit board material having a passage opening at each of the plurality of sites, each opening connecting the upper and lower side;

b) providing and placing at least one heating element at each of the plurality of sites, each heating element having a circumferential edge region and a heating surface surrounded by the edge region, each of the at least one heating elements fully or partially covering the passage opening from the upper to the lower side of the circuit board portion at the respective site;

c) at least partial covering each site with a sealing material for the formation of a partial sheathing for each formed vaporizer unit, the sealing material being applied in such a manner that the sheathing formed from the sealing material covers at least the edge region of each heating element while keeping open the heating surface at least on an upper side of the flexible circuit board material, and at least an outer surface of the sheathing pointing away from the circuit board material and/or from the heating element forms sealing surfaces; and forming circuit board portions from the flexible circuit board material, each circuit board portions each comprising at least two conductor paths and one of the passage openings.

2. The method according to claim 1, wherein:

the flexible circuit board material is pre-structured at least with the conductor paths predetermined in terms of position and/or course for each site; and the method further comprising electrically connecting the at least one heating element placed at each site to the conductor paths at the site.

3. The method according to claim 2, wherein the flexible circuit board material is pre-structured at least with pre-punched areas predetermined in terms of position and/or course for each site.

4. The method according to claim 2, wherein:

in step a) the flexible circuit board material has at least one site for an RFID chip formed in a region of each of the plurality of sites; and the flexible circuit board is pre-structured in terms of position and/or course of predetermined conductor paths as an RFID antenna.

5. The method according to claim 4, wherein the flexible circuit board material is pre-structured at least with the conductor paths and/or pre-punched areas predetermined in terms of position and/or course for each site for electronic connection of at least the RFID chip.

6. The method according to claim 5, further comprising a step k), which can be performed before, with or after step b), comprising providing and placing an RFID chip at each site.

7. The method according to claim 6, further comprising:

connecting the RFID chip at each site to the conductor paths for the electronic connection of at least the RFID chip; and connecting the RFID chip at each site forms the RFID antenna.

8. The method according to claim 4, wherein step c) further comprises covering each site for the RFID chip with the sealing material while additionally forming the sealing surfaces for partial covering of each site for the heating element.

9. The method according to claim 1, wherein step a) comprises rolling out the circuit board material stored on rolls or supplying portions of the circuit board material stored in magazines.

10. The method according to claim 1, wherein:

step c) further comprises each site being enclosed at least partially with the sealing material such that the sealing surfaces form an existing connection free of additional sealants for connection to the components of the inhaler surrounding the vaporizer unit, and the sealing surfaces form both on the upper side and on the lower side of the flexible circuit board material.

11. The method according to claim 3, wherein step b) comprises:

as step b1) applying electric contacting material at least on contact surfaces of the conductor paths at each site on the upper side the flexible circuit board material;

as step b2) placing the at least one heating element in a region of each site such that one of the pre-punched areas, which connects the upper side to the lower side of the circuit board material, is fully or partially covered by the at least one heating element; and as step b3) forming an electric connection between the heating element and conductor paths at each site.

12. The method according to claim 6, wherein step k) comprises:

as step k1) applying electric contacting material at least on contact surfaces of the conductor paths at each site on the upper side of the flexible circuit board material;

as step k2) placing of the RFID chip in the region of each site; and as step k3) forming an electric connection between the RFID chip and the conductor paths at each site.

13. The method according to claim 1, further comprising, after step c), as step d), removing sprue portions of the sealing material generated when covering the sites with the sealing material.

14. The method according to claim 9, further comprising, after step c), as step e) rolling up or onto a roll or collecting in a magazine the circuit board material provided with the plurality of finished vaporizer units.

15. The method according to claim 1, further comprising, as step f) isolating the vaporizer units from the flexible circuit board material for further use.

16. The method according to claim 1, further comprising, as step g), placing at least one wick element on or at the upper side of the flexible circuit board material on at least a part of the open heating surfaces of the heating elements at each site.

17. The method according to claim 16, wherein each wick element is placed in either with step b) or after step b).

18. The method according to claim 11, further comprising, as step h), placing at least one additional electronic component in the region of each site.

19. The method according to claim 18, further comprising, prior to step h), applying contacting material on contact surfaces of the conductor paths at each site on the upper side and/or the lower side of the flexible circuit board material and after step h), forming an electric connection between each additional electronic component and the conductor paths at each site.

20. The method according to claim 19, wherein the steps of forming the electrical connection for the heating element and the additional electronic component and the conductor paths comprises direct contacting by means of silver sintering, eutectic bonding, conductive gluing, anisotropically conductive gluing, KlettWelding, KlettSintering, soldering, or welding.

21. The method according to claim 1, further comprising, in step c), forming at least portions of an air flow channel during covering of each site with the sealing material on the lower side of the circuit board material at each site.

22. The method according to claim 1, further comprising:

placing at each site a tubular, prefabricated portion to form part of an air flow channel on the lower side of the circuit board material; and enclosing and thus fixing the prefabricated portion with additional sealing material.

23. The method according to claim 2, wherein at least steps a) to c) are executed consecutively in each case at a separate or the same production station of a production line in such a manner that a plurality of sites are processed at the same time during each step.

24. The method according to claim 23, wherein the entire production process of the vaporizer units is performed in a joint production line with several production stations.

25. The method according to claim 23, wherein the flexible, pre-structured circuit board material is unwound as a continuous strand from a supply roll and transported continuously or intermittently through the production line comprising several production stations.

26. A vaporizer unit as a component of an inhaler, comprising:

a circuit board portion composed of flexible circuit board material and having an upper side and a lower side, the circuit board portion comprising at least two conductor paths and a passage opening which connects the upper side to the lower side;

at least one heating element fully or partially covering the passage opening from the upper to the lower side of the circuit board portion, the at least one heating element having a heating surface;

a sheathing composed of sealing material at least partially covering the circuit board portion and the heating element while keeping open the heating surface, the sheathing forming sealing surfaces towards an outside of the sealing material.

27. A vaporizer unit according to claim 26, wherein the circuit board portion comprises at least one RFID chip and at least one RFID antenna.

28. A vaporizer unit according to claim 26, wherein:

the circuit board portion is formed from polyimide;

the heating element is a doped silicon chip connected by direct contacting by means of silver sintering electrically to the conductor paths; and the sheathing is silicon or polyimide, the sheathing at least partially enclosing the circuit board portion and the silicon chip such that the silicon chip is mechanically retained.

29. A vaporizer unit according to claim 26, wherein the conductor paths are embedded in the flexible circuit board material and project in a bendable manner out of the sheathing formed by the sealing material for the formation of a flex contacting.

30. A vaporizer unit according to claim 26, further comprising a wick element at least partially covering the heating surface of the heating element.

31. A vaporizer unit according to claim 26, further comprising at least one tube portion formed and/or arranged as a portion of an air flow channel on the lower side of the circuit board portion, the tube portion having an opening directed towards the heating element.

32. A vaporizer assembly as a component of an inhaler, comprising:

a vaporizer unit according to claim 26;

an adapter plug into which the vaporizer unit is plugged;

wherein the vaporizer unit or its sheathing bears at least partially with an outer surface of the sheathing in a sealing manner against an inner geometry of the adapter plug.

33. A vaporizer assembly according to claim 32, wherein at least one portion of an air flow channel is formed by the vaporizer unit and/or the adapter plug.

34. A vaporizer cartridge as a component of an inhaler, comprising a hollow body with at least one portion of an air flow channel;

a supply tank for storing liquid;

as a vaporizer assembly according to claim 32;

the vaporizer assembly being connected to the hollow body and the supply tank in a sealing manner such that the portion of the air flow channel of the vaporizer assembly and the portion of the air flow channel of the hollow body form a joint air flow channel; and the supply tank having at least one access opening to the air flow channel in which the vaporizer unit is placed.

35. An inhaler, formed and configured for inhaling vapor/aerosol enriched with active ingredients and/or flavourings, comprising:

a cartridge carrier having at least one electronic control unit and an electric energy source; and a vaporizer cartridge according to claim 34.

* * * * *